US005248842A

United States Patent [19]

Saito

[11] Patent Number: 5,248,842

[45] Date of Patent: Sep. 28, 1993

[54] DEVICE FOR GENERATING A WAVEFORM OF A MUSICAL TONE

[75] Inventor: Tsutomu Saito, Iwata, Japan

[73] Assignee: Kawai Musical Inst. Mfg. Co., Ltd., Sizuoka, Japan

[21] Appl. No.: 931,426

[22] Filed: Aug. 24, 1992

Related U.S. Application Data

[63] Continuation of Ser. No. 458,452, Dec. 28, 1989, abandoned.

[30] Foreign Application Priority Data

Dec. 30, 1988 [JP] Japan ..... 63-334937

[51] Int. Cl.[5] ..... G10H 7/02

[52] U.S. Cl. ..... 84/602; 84/604; 84/622; 84/631

[58] Field of Search ..... 84/601, 602, 631, 602-607

[56] References Cited

U.S. PATENT DOCUMENTS

| | | | |
|---|---|---|---|
| 4,492,142 | 1/1985 | Oya et al. | 84/604 |
| 4,566,364 | 1/1986 | Katoh | 84/625 |
| 4,597,318 | 7/1986 | Nikaido et al. | 84/625 |
| 4,622,877 | 11/1986 | Strong | 84/604 |
| 4,711,148 | 9/1987 | Takeda et al. | 84/645 X |
| 4,719,834 | 1/1987 | Hall et al. | 84/DIG. 22 |
| 4,781,097 | 11/1988 | Uchiyama et al. | 84/DIG. 12 |
| 4,785,702 | 11/1988 | Katoh | 84/604 |
| 4,864,625 | 9/1989 | Hanzawa et al. | 84/604 X |
| 4,890,527 | 1/1990 | Suzuki et al. | 84/625 X |
| 4,939,973 | 7/1990 | Suzuki | 84/625 X |
| 4,957,552 | 9/1990 | Iwase | 84/631 X |
| 5,020,410 | 6/1991 | Sasaki | 84/602 |

FOREIGN PATENT DOCUMENTS 51-124415 10/1976 Japan .

*Primary Examiner*—William M. Shoop, Jr.
*Assistant Examiner*—Brian Sircus

[57] ABSTRACT

A device for generating a waveform of a musical tone, which comprises a waveform data memory for storing data representing the waveforms of a plurality of musical tones, a waveform data selector for selecting any combination of more than two waveform data stored in the waveform data memory, a sound emission instructing unit for issuing an instruction for emitting a musical tone, a waveform data reading unit for reading out the waveform data selected by the waveform data selector from the waveform data memory in a reading step of a processing program common to the musical tones, in response to an instruction issued by the sound emission instructing unit by effecting a time sharing processing, and a synthesizing unit for accumulating and synthesizing the waveform data read out by the waveform data reading unit.

27 Claims, 32 Drawing Sheets

FIG. 6

320

| | 15 | 14 | 13 | 12 | 11 | 10 | 9 | 8 | 7 | 6 | 5 | 4 | 3 | 2 | 1 | 0 | |
|---|---|---|---|---|---|---|---|---|---|---|---|---|---|---|---|---|---|
| 00 | BANK (B) | | | | ENVELOPE GROUP (B) | | | | BANK (A) | | | | ENVELOPE GROUP (A) | | | | CH0 |
| 01 | FREQUENCY NUMBER SPEED FS | | | | | | | | | | | | | | | | |
| 02 | KEY ON | D816 | GROUP GR | | — | | | | INITIAL FREQUENCY NUMBER | | | | | | | | |
| 03 | LOOP TOP | | | | | | | | LOOP END | | | | | | | | |
| 04 | BANK (B) | | | | ENVELOPE GROUP (B) | | | | BANK (A) | | | | ENVELOPE GROUP (A) | | | | CH1 |
| 05 | FREQUENCY NUMBER SPEED FS | | | | | | | | | | | | | | | | |
| 06 | KEY ON | D816 | GROUP GR | | — | | | | INITIAL FREQUENCY NUMBER | | | | | | | | |
| 07 | LOOP TOP | | | | | | | | LOOP END | | | | | | | | |
| ⋮ | | | | | | | | | | | | | | | | | |
| 3C | BANK (B) | | | | ENVELOPE GROUP (B) | | | | BANK (A) | | | | ENVELOPE GROUP (A) | | | | CH15 |
| 3D | FREQUENCY NUMBER SPEED FS | | | | | | | | | | | | | | | | |
| 3E | KEY ON | D816 | GROUP GR | | — | | | | INITIAL FREQUENCY NUMBER | | | | | | | | |
| 3F | LOOP TOP | | | | | | | | LOOP END | | | | | | | | |
| 40 | PHASE 0 ENVELOPE LEVEL EL | | | | | | | EDU | THINNING-OUT | | ENVELOPE SPEED ES | | | | | | EG0 |
| 41 | PHASE 1 ENVELOPE LEVEL EL | | | | | | | EDU | THINNING-OUT | | ENVELOPE SPEED ES | | | | | | |
| 42 | PHASE 2 ENVELOPE LEVEL EL | | | | | | | EDU | THINNING-OUT | | ENVELOPE SPEED ES | | | | | | |
| 43 | PHASE 3 ENVELOPE LEVEL EL | | | | | | | EDU | THINNING-OUT | | ENVELOPE SPEED ES | | | | | | |
| 44 | PHASE 0 ENVELOPE LEVEL EL | | | | | | | EDU | THINNING-OUT | | ENVELOPE SPEED ES | | | | | | EG1 |
| 45 | PHASE 1 ENVELOPE LEVEL EL | | | | | | | EDU | THINNING-OUT | | ENVELOPE SPEED ES | | | | | | |
| 46 | PHASE 2 ENVELOPE LEVEL EL | | | | | | | EDU | THINNING-OUT | | ENVELOPE SPEED ES | | | | | | |
| 47 | PHASE 3 ENVELOPE LEVEL EL | | | | | | | EDU | THINNING-OUT | | ENVELOPE SPEED ES | | | | | | |
| ⋮ | | | | | | | | | | | | | | | | | |
| 7C | PHASE 0 ENVELOPE LEVEL EL | | | | | | | EDU | THINNING-OUT | | ENVELOPE SPEED ES | | | | | | EG15 |
| 7D | PHASE 1 ENVELOPE LEVEL EL | | | | | | | EDU | THINNING-OUT | | ENVELOPE SPEED ES | | | | | | |
| 7E | PHASE 2 ENVELOPE LEVEL EL | | | | | | | EDU | THINNING-OUT | | ENVELOPE SPEED ES | | | | | | |
| 7F | PHASE 3 ENVELOPE LEVEL EL | | | | | | | EDU | THINNING-OUT | | ENVELOPE SPEED ES | | | | | | |

| 8 | 7 | 6 | 5 | 4 | 3 | 2 | 1 | 0 |
|---|---|---|---|---|---|---|---|---|
| EDU | TH1 | TH0 | ES5 | ES4 | ES3 | ES2 | ES1 | ES0 |

CONVENTIONAL SYSTEM

APPLICANT'S SYSTEM (D816 = 'L')

VOLTAGE
G0
D0
R0
E0
G1
D1
R1
E1
G2
D2
R
E2
G3
D3
R
E3
G4
D4
R
E4
G5
O: SAMPLED VALUE
o: INTERPOLATED VALUE
x: ESTIMATED VALUE
ACCUMULATED FREQUENCY NUMBER
FA9 0 1 0 1 0 1

FIG. 14(A) IES= "L"

| RD4 | RD3 | RD2 | IES | IE8 | IE7 | IE6 | IE5 | IE4 | IE3 | IE2 | IE1 | IE0 |
|---|---|---|---|---|---|---|---|---|---|---|---|---|
| 0 | 0 | 0 | 0 | 0 | 0 | 0 | 0 | 0 | 0 | 0 | RD1 | RD0 |
| 0 | 0 | 1 | 0 | 0 | 0 | 0 | 0 | 0 | 0 | 1 | RD1 | RD0 |
| 0 | 1 | 0 | 0 | 0 | 0 | 0 | 0 | 0 | 1 | RD1 | RD0 | 0 |
| 0 | 1 | 1 | 0 | 0 | 0 | 0 | 0 | 1 | RD1 | RD0 | 0 | 0 |
| 1 | 0 | 0 | 0 | 0 | 0 | 0 | 1 | RD1 | RD0 | 0 | 0 | 0 |
| 1 | 0 | 1 | 0 | 0 | 0 | 1 | RD1 | RD0 | 0 | 0 | 0 | 0 |
| 1 | 1 | 0 | 0 | 0 | 1 | RD1 | RD0 | 0 | 0 | 0 | 0 | 0 |
| 1 | 1 | 1 | 0 | 1 | RD1 | RD0 | 0 | 0 | 0 | 0 | 0 | 0 |

FIG 14(B) IES= "H"

| RD4 | RD3 | RD2 | IES | IE8 | IE7 | IE6 | IE5 | IE4 | IE3 | IE2 | IE1 | IE0 |
|---|---|---|---|---|---|---|---|---|---|---|---|---|
| 0 | 0 | 0 | 1 | 1 | 1 | 1 | 1 | 1 | 1 | RG2 | RG1 | RG0 |
| 0 | 0 | 1 | 1 | 1 | 1 | 1 | 1 | 1 | 1 | RG2 | RG1 | RG0 |
| 0 | 1 | 0 | 1 | 1 | 1 | 1 | 1 | 1 | RG2 | RG1 | RG0 | 0 |
| 0 | 1 | 1 | 1 | 1 | 1 | 1 | 1 | RG2 | RG1 | RG0 | 0 | 0 |
| 1 | 0 | 0 | 1 | 1 | 1 | 1 | RG2 | RG1 | RG0 | 0 | 0 | 0 |
| 1 | 0 | 1 | 1 | 1 | 1 | RG2 | RG1 | RG0 | 0 | 0 | 0 | 0 |
| 1 | 1 | 0 | 1 | 1 | RG2 | RG1 | RG0 | 0 | 0 | 0 | 0 | 0 |
| 1 | 1 | 1 | 1 | RG2 | RG1 | RG0 | 0 | 0 | 0 | 0 | 0 | 0 |

$RG0 = RD0$ $RG1 = \overline{RD0 \oplus RD1}$ $RG2 = \overline{RD0 + RD1 \oplus RD2 + RD3 + RD4}$

FIG. 15(A)

RD2、3、4= "000"

| RD1 | RD0 | RG2 | RG1 | RG0 | DIFFERENCED DATA |
|---|---|---|---|---|---|
| 0 | 0 | 0 | 0 | 0 | UNUSED |
| 0 | 1 | 1 | 1 | 1 | −1 |
| 1 | 0 | 1 | 1 | 0 | −2 |
| 1 | 1 | 1 | 0 | 1 | −3 |

FIG. 15(B)

RD2、3、4= "000"

| RD1 | RD0 | RG2 | RG1 | RG0 | DIFFERENCED DATA |
|---|---|---|---|---|---|
| 0 | 0 | 1 | 0 | 0 | $-4\times2^{*}$ |
| 0 | 1 | 0 | 1 | 1 | $-5\times2^{*}$ |
| 1 | 0 | 0 | 1 | 0 | $-6\times2^{*}$ |
| 1 | 1 | 0 | 0 | 1 | $-7\times2^{*}$ |

*=1,2,3

FIG. 16

| FRACTION PART | | | MULTIPLIER FACTOR | | | INTERPOLATED VALUE |
|---|---|---|---|---|---|---|
| FA11 | FA10 | FA9 | IM2 | IM1 | IM0 | (SIGN= "0") |
| 0 | 0 | 0 | 1 | 0 | 0 | SAMPLED.−4/4×DIFFERENCED. |
| 0 | 0 | 1 | 0 | 1 | 1 | SAMPLED.−3/4×DIFFERENCED. |
| 0 | 1 | 0 | 0 | 1 | 0 | SAMPLED.−2/4×DIFFERENCED. |
| 0 | 1 | 1 | 0 | 0 | 1 | SAMPLED.−1/4×DIFFERENCED. |
| 1 | 0 | 0 | 0 | 0 | 0 | SAMPLED. |
| 1 | 0 | 1 | 0 | 0 | 1 | SAMPLED.+1/4×DIFFERENCED. |
| 1 | 1 | 0 | 0 | 1 | 0 | SAMPLED.+2/4×DIFFERENCED. |
| 1 | 1 | 1 | 0 | 1 | 1 | SAMPLED.+3/4×DIFFERENCED. |

FIG. 22

| ES5 | ES4 | ES3 | ES2 | ESE 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | ES1 | ES0 |
| 0 | 0 | 0 | 1 | 0 | 0 | 0 | 0 | 0 | 0 | 0 | 0 | 0 | 0 | 0 | 0 | 0 | 1 | ES1 | ES0 |
| 0 | 0 | 1 | 0 | 0 | 0 | 0 | 0 | 0 | 0 | 0 | 0 | 0 | 0 | 0 | 0 | 1 | ES1 | ES0 | 0 |
| 0 | 0 | 1 | 1 | 0 | 0 | 0 | 0 | 0 | 0 | 0 | 0 | 0 | 0 | 0 | 1 | ES1 | ES0 | 0 | 0 |
| 0 | 1 | 0 | 0 | 0 | 0 | 0 | 0 | 0 | 0 | 0 | 0 | 0 | 0 | 1 | ES1 | ES0 | 0 | 0 | 0 |
| 0 | 1 | 0 | 1 | 0 | 0 | 0 | 0 | 0 | 0 | 0 | 0 | 0 | 1 | ES1 | ES0 | 0 | 0 | 0 | 0 |
| 0 | 1 | 1 | 1 | 0 | 0 | 0 | 0 | 0 | 0 | 0 | 0 | 1 | ES1 | ES0 | 0 | 0 | 0 | 0 | 0 |
| | | | | ... | ... | ... | ... | ... | ... | ... | ... | ... | ... | ... | ... | ... | ... | ... | ... |
| 1 | 1 | 0 | 1 | 0 | 1 | ES1 | ES0 | 0 | 0 | 0 | 0 | 0 | 0 | 0 | 0 | 0 | 0 | 0 | 0 |
| 1 | 1 | 1 | 0 | 1 | ES1 | ES0 | 0 | 0 | 0 | 0 | 0 | 0 | 0 | 0 | 0 | 0 | 0 | 0 | 0 |
| 1 | 1 | 1 | 1 | UNUSED | | | | | | | | | | | | | | | |

FIG. 23

| | 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|---|
| EA15 | 0 | 0 | 0 | 0 | 0 | 0 | 0 | 0 | 0 | 0 | 0 | 0 | 0 | 0 | 0 | 0 |
| EA14 | 0 | 0 | 0 | 0 | 0 | 0 | 0 | 0 | 0 | 0 | 0 | 0 | 0 | 0 | 0 | 0 |
| EA13 | 0 | 0 | 0 | 0 | 0 | 0 | 0 | 0 | 0 | 0 | 0 | 0 | 0 | 0 | 0 | 0 |
| EA12 | SS15 | SS14 | SS13 | SS12 | SS11 | SS10 | SS9 | SS8 | SS7 | SS6 | SS5 | SS4 | SS3 | SS2 | SS1 | SS0 |
| EA11 | 0 | 0 | 0 | 0 | 0 | 0 | 0 | 0 | 0 | 0 | 0 | 0 | 0 | 0 | 0 | 1 |
| ... | ... | ... | ... | ... | ... | ... | ... | ... | ... | ... | ... | ... | ... | ... | ... | ... |
| EA0 | SS15 | SS14 | SS13 | SS12 | SS11 | SS10 | SS9 | SS8 | SS7 | SS6 | SS5 | SS4 | SS3 | SS2 | SS1 | SS0 |
| EA15 | 1 | 0 | 0 | 0 | 0 | 0 | 0 | 0 | 0 | 0 | 0 | 0 | 0 | 0 | 0 | 0 |
| EA14 | 0 | 0 | 0 | 0 | 0 | 0 | 0 | 0 | 0 | 0 | 0 | 0 | 0 | 0 | 0 | 0 |
| EA13 | 0 | 0 | 0 | 0 | 0 | 0 | 0 | 0 | 0 | 0 | 0 | 0 | 0 | 0 | 0 | 1 |
| EA12 | SS15 | SS14 | SS13 | SS12 | SS11 | SS10 | SS9 | SS8 | SS7 | SS6 | SS5 | SS4 | SS3 | SS2 | SS1 | SS0 |
| EA11 | 0 | 0 | 0 | 0 | 0 | 0 | 0 | 0 | 0 | 0 | 0 | 0 | 0 | 0 | 1 | 0 |
| ... | ... | ... | ... | ... | ... | ... | ... | ... | ... | ... | ... | ... | ... | ... | ... | ... |
| EA0 | SS15 | SS14 | SS13 | SS12 | SS11 | SS10 | SS9 | SS8 | SS7 | SS6 | SS5 | SS4 | SS3 | SS2 | SS1 | SS0 |
| EA15 | 1 | 0 | 0 | 0 | 0 | 0 | 0 | 0 | 0 | 0 | 0 | 0 | 0 | 0 | 1 | 0 |
| EA14 | 0 | 0 | 0 | 0 | 0 | 0 | 0 | 0 | 0 | 0 | 0 | 0 | 0 | 1 | 0 | 0 |
| EA13 | 0 | 0 | 0 | 0 | 0 | 0 | 0 | 0 | 0 | 0 | 0 | 0 | 1 | 0 | 0 | 1 |
| EA12 | 0 | SS15 | SS14 | SS13 | SS12 | SS11 | SS10 | SS9 | SS8 | SS7 | SS6 | SS5 | SS4 | SS3 | SS2 | SS1 |
| EA11 | 1 | 0 | 0 | 0 | 0 | 0 | 0 | 0 | 0 | 0 | 0 | 0 | 0 | 1 | 0 | 0 |
| EA10 | 0 | 0 | 0 | 0 | 0 | 0 | 0 | 0 | 0 | 0 | 0 | 0 | 1 | 0 | 0 | 1 |
| EA9 | 0 | 0 | 0 | 0 | 0 | 0 | 0 | 0 | 0 | 0 | 0 | 1 | 0 | 0 | 1 | 0 |
| EA8 | 0 | 0 | 0 | 0 | 0 | 0 | 0 | 0 | 0 | 0 | 1 | 0 | 0 | 1 | 0 | 1 |
| EA7 | 0 | 0 | 0 | 0 | 0 | 0 | 0 | 0 | 0 | 1 | 0 | 0 | 1 | 0 | 1 | 1 |
| EA6 | 0 | 0 | 0 | 0 | 0 | 0 | 0 | 0 | 1 | 0 | 0 | 1 | 0 | 1 | 1 | 0 |
| EA5 | 0 | 0 | 0 | 0 | 0 | 0 | 0 | 1 | 0 | 0 | 1 | 0 | 1 | 1 | 0 | 1 |
| EA4 | 0 | 0 | 0 | 0 | 0 | 0 | 1 | 0 | 0 | 1 | 0 | 1 | 1 | 0 | 1 | 1 |
| EA3 | 0 | 0 | 0 | 0 | 0 | 1 | 0 | 0 | 1 | 0 | 1 | 1 | 0 | 1 | 1 | 1 |
| EA2 | 0 | 0 | 0 | 0 | 1 | 0 | 0 | 1 | 0 | 1 | 1 | 0 | 1 | 1 | 1 | 1 |

FIG. 24

FIG. 27

ORDINARY FORM

LOGARITHMIC FORM

FIG. 28(A)

| KEY ON | PH1 | PH0 | PA1 | PA0 |
|---|---|---|---|---|
| 0 | 0 | 0 | 1 | 1 |
| 0 | 0 | 1 | 1 | 1 |
| 0 | 1 | 0 | 1 | 1 |
| 0 | 1 | 1 | 1 | 1 |
| 1 | 0 | 0 | 0 | 0 |
| 1 | 0 | 1 | 0 | 1 |
| 1 | 1 | 0 | 1 | 0 |
| 1 | 1 | 1 | 0 | 0 |

FIG. 28(B)

| ECS | PA1 | PA0 | PB1 | PB0 |
|---|---|---|---|---|
| 0 | 0 | 0 | 0 | 0 |
| 0 | 0 | 1 | 0 | 1 |
| 0 | 1 | 0 | 1 | 0 |
| 0 | 1 | 1 | 1 | 1 |
| 1 | 0 | 0 | 0 | 1 |
| 1 | 0 | 1 | 1 | 0 |
| 1 | 1 | 0 | 1 | 0 |
| 1 | 1 | 1 | 1 | 1 |

DEVICE FOR GENERATING A WAVEFORM OF A MUSICAL TONE

This application is a continuation of application Ser. No. 07/458,452 filed on Dec. 28, 1989, now abandoned.

BACKGROUND OF THE INVENTION

1. Field of The Invention

This invention relates to an electronic musical instrument, and more particularly, to a device of generating a waveform of a musical tone (hereunder also referred to simply as a musical tone waveform generating device) for use in the electronic musical instrument.

2. Description of the Related Art

Conventionally, musical instruments which can simultaneously generate a plurality of musical tones, i.e., polyphonic musical instruments, are widely used. In such conventional polyphonic musical instruments, a plurality of channels for generating musical tones by a time sharing processing are formed, and a musical tone corresponding to each different key simultaneously operated is assigned to a corresponding one of the channels. To read out waveform data of keys which simultaneously produce a sound, i.e., data of a plurality of musical tones to be simultaneously generated from a waveform data memory, a shift register having the same number of stages as the number of the channels is provided in a frequency number (i.e., data representing the value of a frequency) accumulator used as a read-out address counter, and an accumulated frequency number corresponding to a corresponding channel is set in each stage of the register and further, a frequency number is accumulated therein by an appropriate timing for each channel.

In this connection, Japanese Patent Unexamined Publication No. 51-124415 has proposed a system in which two waveform data are simultaneously read out by only one operation of a key, and then synthesized, so that the range of the musical tone generated as the result of one operation of a key is widened.

In such a conventional system, however, the combination of two waveforms to be simultaneously read out and synthesized is fixed, and therefore, the conventional system cannot variegate a musical tone generated by one operation of a key. Further, an envelope waveform is common between the two waveforms to be synthesized, and thus the conventional system cannot widen the range of the musical tone generated by one operation of a key.

The present invention is intended to solve the problems of the conventional systems.

SUMMARY OF THE INVENTION

Accordingly, an object of the present invention is to provide a musical tone waveform generating device which can variegate a musical tone generated in response to an instruction for generating such a musical tone.

To achieve the foregoing object and in accordance with a first aspect of the present invention, there is provided a musical tone waveform generating device wherein, in response to an instruction for generating a musical tone, respective waveform data are arbitrarily selected and combined, are read out at a common reading step by effecting a time sharing processing, are accumulated, and are synthesized.

In accordance with a second aspect of the present invention, there is provided a musical tone waveform generating device wherein, in response to an instruction for generating a musical tone, the arbitrarily selected and combined waveform data are read out at a common reading step by effecting a time sharing processing, are further separately controlled, are accumulated, and are synthesized.

Accordingly, data of more than two waveforms read out in response to an instruction for generating a musical tone can by arbitrarily combined. Further, the data of the waveforms to be combined are separately controlled by using an envelope, and thus the generated musical tone can be changed during the period from the time of the initiation of the generating of the musical tone to the termination of the generating of the musical tone.

Thereby both of the data and the program, or both of a storing area which a CPU reads and storing area which a tone generating means reads, can be implemented together in a storage device. Further it effects that a configuration and an information processing of the system is simple. An example of such a system is composed of ROM 20, ROM address controlling circuit 31, selector 313, FS accumulator 40 and CPU 300, as shown in FIGS. 1 and 4. The A input connector and a B input connector of the selector 313 is switched by a clock signal CK2 from a master clock generator 10 in a time sharing manner. An address data from the CPU 300 is added to an MMU address and is inputted to the A input connector of the selector 313 and is sent to the ROM 20. Therefore, the program or data is read from the ROM 20 by the CPU 300. An accumulated frequency number speed data FA12-16 from the FS accumulator 40 is added to a bank data BK0-3 from the FS accumulator 40 and is inputted to the B input connector of the selector 313 and is sent to the ROM 20. Therefore, a waveform data RD is read from the ROM 20 by the FS accumulator 40.

A still further object of the present invention is to provide a system for storing information on musical sounds.

To attain this object, and in accordance with a third aspect of the present invention, there is provided a system which has a central processing unit for storing information on musical sounds and further comprises a data storing means for storing data representing musical sounds, a program storing means integrated with the data storing means for storing a processing program to be executed for generating and radiating musical sounds, a data reading means for reading the data from the data storing means, a program reading means for reading the processing program from said program storing means and a switching means of switching a reading operation from the reading of the data by the data reading means to that of the processing program by said program reading means and vice versa.

Thereby both of the data and the program can be stored in a storage device. Further, a reading operation to be effected by the system can be switched from the reading of the data by the data reading means to that of the processing program by said program reading means and vice versa only by changing the address data by the difference in address between a storage area storing the data and another storage area storing the program. An example of such a system is composed of an MMU latch 310, a selector 312 and a ROM 20 as shown in FIG. 4. In this example, when a program is read out, CPU addresses CA1-15 is selected. When timbre data is read out, only the CPU addresses CA12-15 are changed into MMI addresses. Further, when waveform data is read out, all of the CPU addresses are changed for an accumulated frequency number.

BRIEF DESCRIPTION OF THE DRAWING

Other features, objects and advantages of the present invention will become apparent from the following description of a preferred embodiment with reference to the drawings in which like reference characters designate like or corresponding parts throughout, wherein:

FIG. 6 is a diagram illustrating the contents stored in an assignment storing memory 320 of an assignment storing circuit 32;

FIG. 14*a*, 14*b* is a diagram showing the contents of expanded difference data of the waveform data;

FIG. 15*a*, 15*b* is a diagram for illustrating the conversion of difference mantisse data to converted mantissa data;

FIG. 16 is a diagram for illustrating the relationship among high order bits FA9-11 of the accumulated value of the frequency number, multiplication data IM0-2 of the difference data, and the interpolated waveform data;

FIG. 22 is a diagram showing the contents of the expanded envelope speed data ESE;

FIG. 23 is a diagram for illustrating the relationship between the envelope power data EA12-15 of the accumulated envelope value EA and the envelope speed data ESE, during the attack time;

FIG. 24 is a diagram showing the contents of the accumulated envelope value EA;

FIG. 27 is a diagram showing the contents of phase parameters PH;

FIG. 28A, 28B is a diagram showing the contents of the phase parameters used for the conversion effected in the phase control circuit 30;

DESCRIPTION OF THE PREFERRED EMBODIMENT

Hereinafter, a preferred embodiment of the present invention will be described with reference to the accompanying drawings.

1. Entire Circuit

Figure 1:
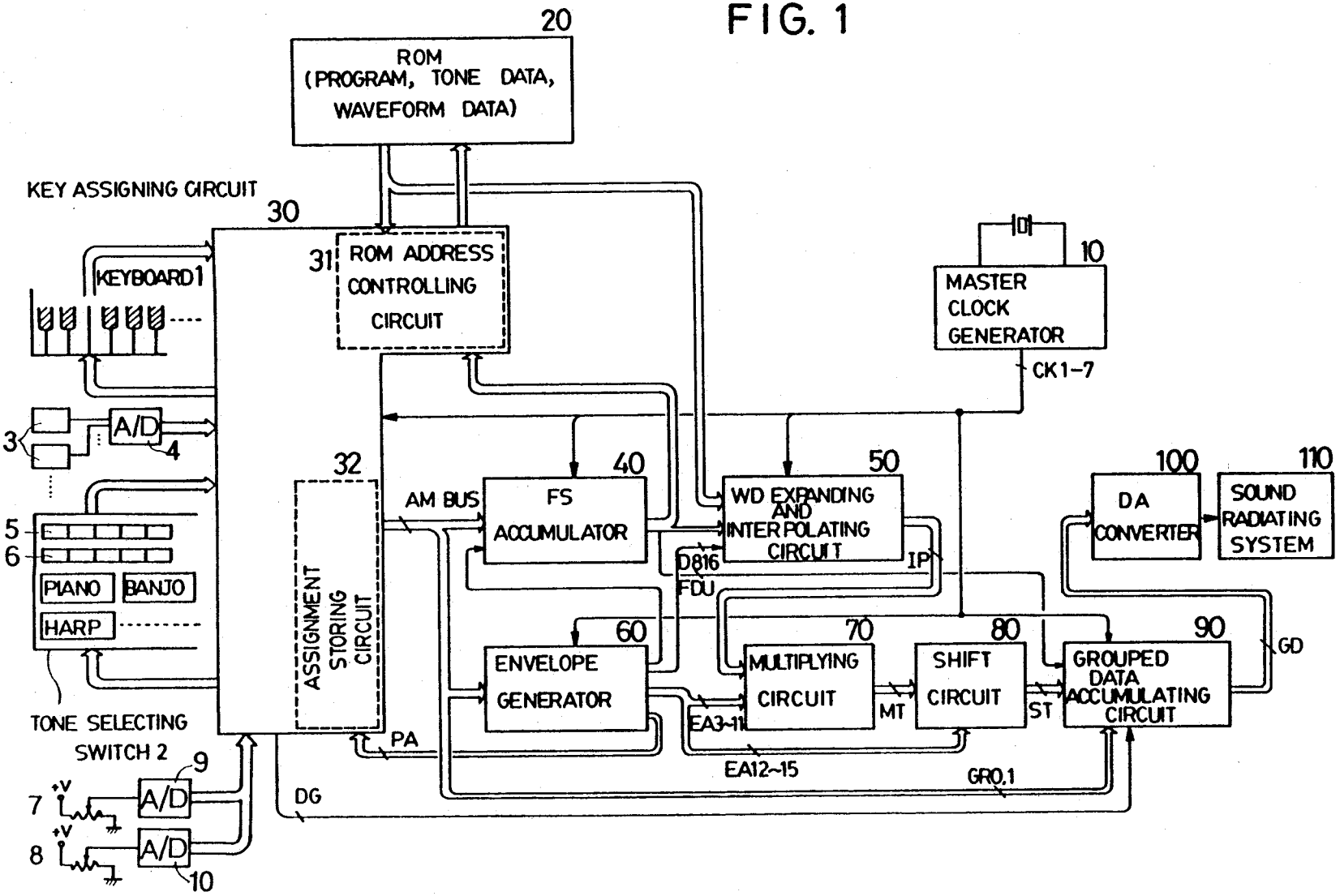
FIG. 1 is a schematic block diagram showing the entire construction of the embodiment of the present invention.

FIG. 1 is a schematic block diagram showing the entire construction of the embodiment of the present invention, wherein each key of a keyboard I and each switch of a tone selecting switch board 2 are scanned by a key assigning circuit 30 (hereinafter referred to simply as a key assigner), and then data of a musical sound having a sound pitch corresponding to an operated key and a tone color corresponding to an operated switch is assigned to an idle channel of a 16-channel musical sound generating system of this embodiment. Further, information on the assignment of the data of the musical sound to the channel is stored in an assignment storing circuit 32. Further, the pressure used for pressing each key of the keyboard I is detected by a pressure sensor 3 provided at each of the keys, is converted into digital "touch data" TO representing the pressure used for a key, and is input to a central processing unit (CPU) 300 described later.

Furthermore, rhythm keys 5 are used for selecting rhythms of, for example, rock music and disco music, and effect keys 6 are used for selecting special effects to be added to the generated tone (for example, portamento, glide, growl, echo, sustain, vibrato, chorus, ensemble, honky-tonk and tremolo, etc.) by turning each of these keys on or off; this turning-on and turning-off of each of the keys is detected by the CPU 300. In addition, angles of rotation of a volume knob 7 and of a tempo knob 8 are detected by a variable resistance as quantities of a change in voltage, and are input through analog-to-digital (A-D) converters 9 and 10 to the CPU 300 as volume data and tempo data, respectively.

A read-only memory (ROM) 20 stores a processing program for generating musical sound signals, tone data relating to waveforms of musical sounds and concerning envelopes used for generating musical sounds and waveform data RD. A ROM address control circuit 31 controls the addressing of locations in the ROM 20, from which the program and the data are read out, to change a reading from one of the processing program, the tone data and the waveform data to another thereof. The processing program read out of the ROM 20 is sent to a central processing unit (CPU) 300 of the key assigner 30, where various processes are performed. Further, the tone data read out of the ROM 20 is written into an area, which corresponds to the idle channel, of the assignment storing circuit 32, and waveform data RD similarly read from the ROM 20 is sent to a waveform data (WD) expanding and interpolating circuit 50. In the assignment storing circuit 32, frequency number speed data FS corresponding to the key operated in the keyboard 1 is also written into the area corresponding to the idle channel.

Frequency number speed data FS corresponding to each channel is sequentially accumulated in a frequency number speed data accumulating device (hereinafter referred to simply as an FS accumulator) 40 and is further supplied to the ROM address controlling circuit 31 as data (hereinafter referred to simply as reading address data) of addresses of the ROM 20 from which the waveform data RD are read out. Accordingly, the waveform data RD corresponding to the frequency number speed data FS (i.e., corresponding to the pitch of the sound) is read out of the ROM 20 and input to the WD expanding and interpolating circuit 50. A large amount of waveform data RD is stored in the ROM 20 and selectively read therefrom in accordance with bank data read out of the assignment storing circuit 32. In the WD expanding and interpolating circuit 50, difference data, obtained by data compression of the waveform data RD and read from the ROM 20, is expanded, and interpolating positions between successive sampling positions of each waveform data RD are obtained. Further, the expanded data and the thus-obtained data indicating the interpolating positions are sent to a multiplying circuit 70. The interpolation of the waveform data RD is effected by using a part of data, sent from the FS accumulator 40, indicating the values of the accumulated frequency number speed data FS.

On the other hand, the data relating to envelope is sent from the assignment storing circuit 32 to an envelope generator 60 which generates envelopes, and thereafter, the thus-generated envelopes are sent therefrom to the multiplying circuit 70, whereupon each value obtained by sampling the expanded and interpolated waveform date IP resulting from the expansion and interpolation of the waveform data RD effected in the circuit 50 is multiplied by each value EA obtained by sampling an envelope waveform. Data ST indicating the result of the multiplication is then sent to and shifted by a shift circuit 80, and the thus-shifted data is grouped by a sound generating system and used to generate sounds therefrom; the data of each group being separately accumulated in a grouped data accumulating circuit 90. Further, the data of each group is sent through a digital-to-analog (DA) converter 100 to a sound radiating system 110, which radiates musical sounds in accordance with the converted data.

The envelope generator 60 sends a signal PA indicating a current phase to the assignment storing circuit 32, and the circuit 32 outputs envelope data relating to the next phase. The envelope generator 60 so sends an on-event signal to the FS accumulator 40 at the start of a "key on" state, i.e. , turning on the key to make the accumulator 40 start accumulating the data FS. Furthermore, the envelope generator 60 sends a data length signal D816 to the WD expanding and interpolating circuit 50 which determines whether or not the interpolation of the waveform data RD is to be effected. The data length signal D816 indicates that the waveform data RD is composed of two sampled values, each of which is represented by using 8 bits, or that the data RD is composed of a sampled value represented by using 10 bits and a difference data represented by using 6 bits. Namely, when the sampled value represented by 10 bits and the difference data represented by 6 bits are read, the interpolation of the waveform data RD is effected.

The shift circuit 80 shifts the data ST, obtained by the multiplication, from left to right (i.e., the data is shifted down) in accordance with the magnitude of an envelope power data, represented by high order bits EA1-2-15 of the accumulated value EA of the envelope, to make the radiated musical sound correspond to natural sound by giving an exponential form to attenuating portions of the envelope corresponding to an attack time and a release time. Note, reference characters referring to consecutive elements such as EA12-EA15 are abbreviated as EA12-15 in this specification, and further, reference characters referring to two elements such as EA11 and EA14 are sometimes abbreviated as EA11. 14.

Further, four musical sound generating groups of the data are formed in the DA converter 100 in a time sharing manner. In response to group data GR sent from the assignment storing circuit 32, the grouped data accumulating circuit 90 determines to which of the musical sound generating groups the data ST received from the shift circuit 80 belongs. This circuit 90 is also supplied by the FS accumulator 40 with a waveform folding signal FDU having a level which becomes high when the generation of a preceding or first half of the waveform of one period or cycle is finished and the generation of the latter or second half of the waveform commences. The grouped data accumulating circuit 90 inverts the musical sound data in response to the signal FDU. Furthermore, a gate signal DG is fed from the key assigner 30 to the circuit 90, which controls the output of the musical sound data to the DA converter 100. On the other hand, a master clock generator 10 sends signals (for example, clock signals CK1-7), described later, shown in FIG. 2 to the circuits 30, 40, 50, 60 and 90 of FIG. 1, to thereby control the timing of various operations of these circuits.

2. ROM 20

Figure 3:
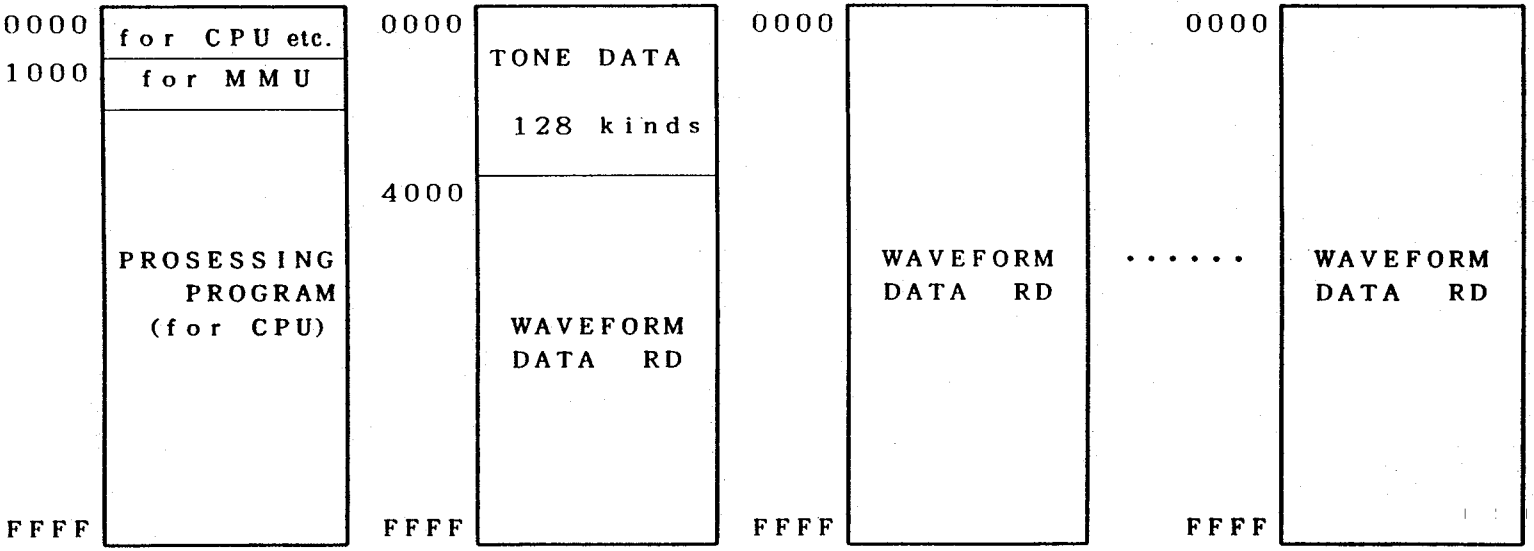
FIG. 3 is a diagram showing the contents stored in a ROM 20.

FIG. 3 shows the contents in the ROM 20. As shown in this figure, this ROM 20 is divided into 16 bank areas, i.e., a bank area "0" to a back area "15", each of which has addresses "$0000_H$" to "$FFFF_H$". (In this specification, the subscript $_H$ indicates that the number is hexadecimal) The addresses "$0000_H$" to "$OFFF_H$" of the bank "0" correspond to used areas of a random access memory (RAM) 301 and an assignment memory 302, etc.. Further, the addresses "$1000_H$" to "$1FFF_H$" of the bank "0" correspond to used areas of an MMU latch 310 described later. Furthermore, processing programs for generating musical tone signals are stored in the areas having addresses "2000 $_H$" to "FFFF $_H$" of the bank "0".

Also, timbre or tone-color data of 128 tones, for selecting and determining the contents of the waveform and the envelope, are stored in the areas having addresses "$0000_H$" to "$3FFF_H$" it of the bank "1".

Further, in the areas having the addresses from "$4000_H$" of the bank "1" to "$FFFF_H$" of the bank "15", two waveform data (A) and (B) RD to be read out therefrom for a selected timbre are stored at the same address in each of the banks. The waveform represented by the waveform data RD may be a sine wave, a triangular wave, a saw-tooth wave, a rectangular wave, a noise wave, and a wave obtained by synthesizing any combination of these waves; may be a plurality of waveforms obtained by synthesizing frequency components which correspond to spectrum groups of a plurality of frequency bands corresponding to specific formants; and may be a pulse code modulation (PCM) waveform using a loop top and a loop end, and so forth.

The top address of the storage area used for storing the tone data is separated from that of the storage area for storing the processing program, by MMU address data explained later. The tone data is composed of bank data, the data length signal data D816, the group data GR, initial frequency number data, loop top data, loop end data and envelope data. The envelope data consists of phase level data or phase parameters PH, envelope add-subtract signal data EDU, thinning-out data TH, and envelope speed data ES.

First, the bank data is used for selecting and designating one of 15 kind of the waveform data RD, and two waveforms (A) and (B) are selected per tone assigned to one channel on the basis of the bank data.

Next, as described above, the data length signal D816 is used for indicating that the waveform data RD is composed of two sampled values each represented by using 8 bits, or that the data RD is composed of one sampled value represented by using 10 bits and one difference data represented by using 6 bits.

Further, as above stated, the group data GRO,1 is used for indicating to which of four musical sound generating groups the data ST obtained by the multiplication is assigned.

Figure 8:
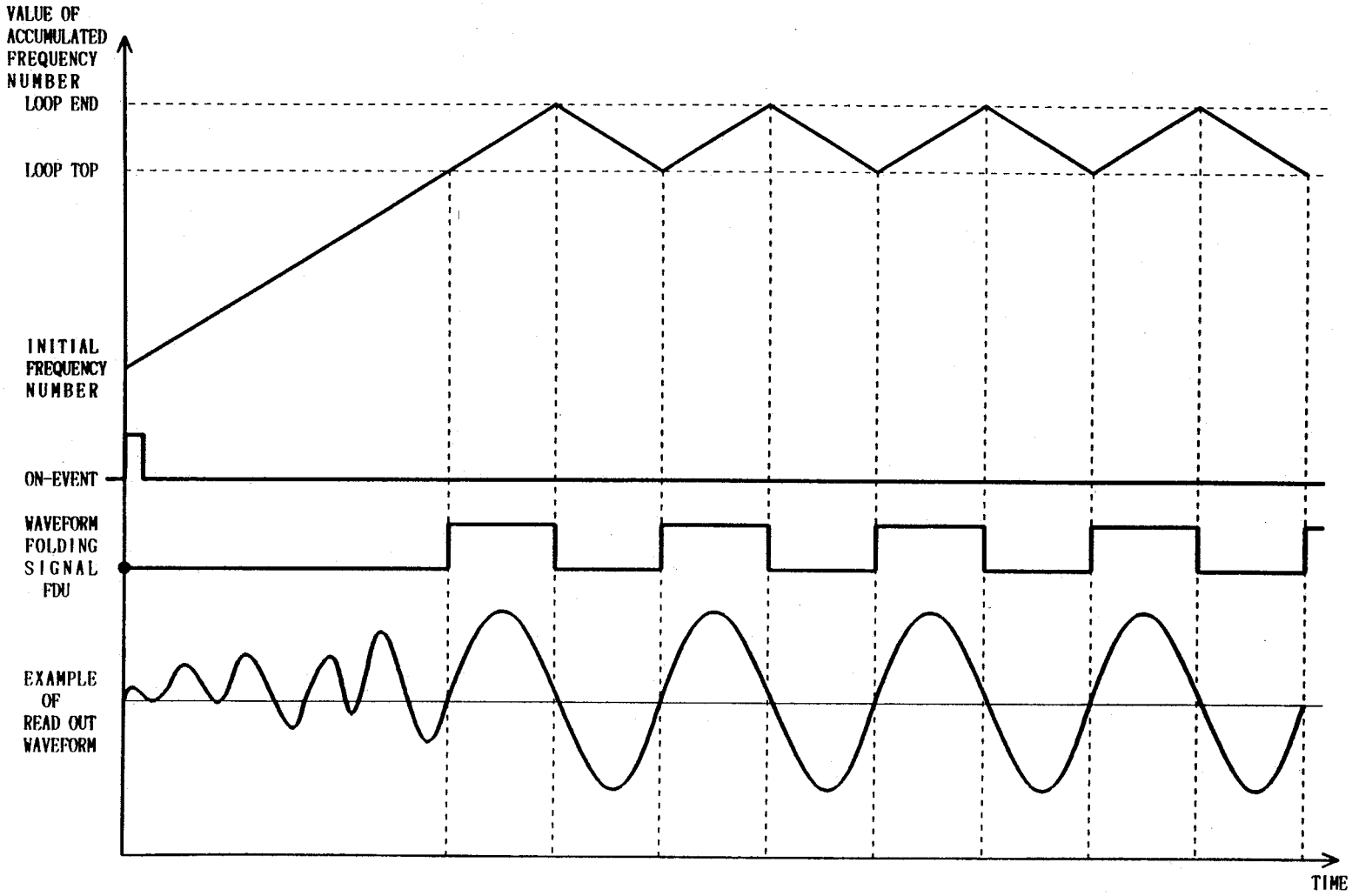
FIG. 8 is a diagram illustrating the manner of reading the waveform data.

Referring now to FIG. 8, at the initiation of the operation of reading the waveform date RD from the ROM 20, an initial value of a parameter or variable used for sequentially accumulating the frequency number speed data FS and reading out the waveform data RD is indicated by the initial frequency number data. The loop end data indicates the value of the accumulated frequency number FA at an upper turning point by which the accumulated frequency number speed data is calculated by serially adding the frequency number speed data FS thereto, and further the loop top date indicates the value of the accumulated frequency number FA at a lower turning point from which the value of the accumulated frequency number FA is calculated by serially subtracting the frequency number speed data FS therefrom. As shown in this figure, the waveform data of the waveforms of first and second half cycles composing the continuous waveform of one cycle can be read out by repeatedly varying the value of the accumulated frequency number FA between the values indicated by the loop top data and the loop end data.

Note, the waveform folding signal FDU indicates the most significant bit of the accumulated frequency number FA. Further, the level of the signal FDU becomes high when the first half cycle is finished and the second half cycle commences. The above described change in the accumulating operation at the turning points (i.e., the change between the addition and the subtraction of the data FS) as well as the inversion of the sign of the sampled values of the waveform data (i.e., the sign of the values of the amplitude of the waveforms, and thus that of the musical sound data) is made on the basis of this signal FDU.

Figure 26:
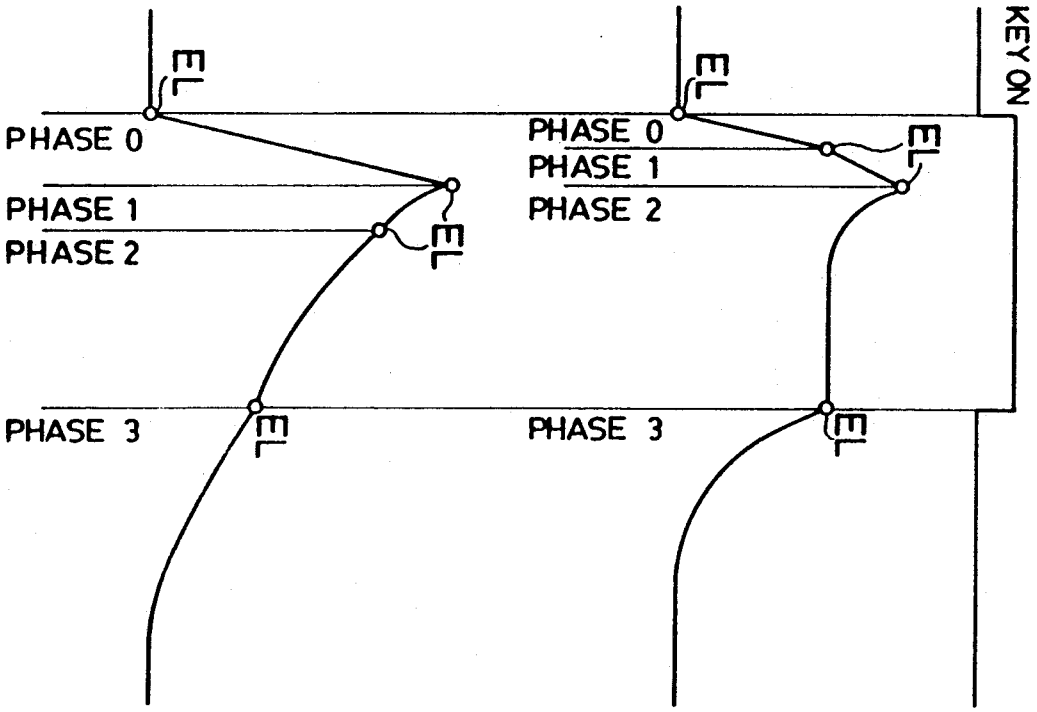
FIG. 26 is a waveform chart for illustrating envelope phases.

The envelope level data of the envelope data indicates the accumulated value of the envelope at the last or terminating points of the attack phase, the decay phase, the sustain phase and the release phase, as shown in FIG. 26. The envelope add-subtract signal data EDU indicates whether an addition or subtraction of the accumulated value EA is to be performed, and the envelope speed data ES of the envelope data indicates the rate or speed of the addition or subtraction of the accumulated value EA of the envelope. The gradient at each point of the envelope waveform is in proportion to the value of the envelope speed data ES. The envelope speed data ES and envelope level data EL are determined in accordance with Key touch data obtained in response to the speed and the pressure by which the key is pressed.

The thinning-out data TH of the envelope data indicates the rate of thinning out the accumulated values EA by latches (hereinafter referred to simply as the latch thinning-out rate) for fetching the accumulated values EA into an accumulating system. Originally, the latching of the accumulated values EA is performed once every time slot repeated with respect to all of the channels, but where the data TH is "11", the thinning of the values EA is not performed, and conversely, where the data TH is "10", "01" and "00", the value EA is fetched into the accumulating system at each of 4 times, 16 times and 64 times of the latching thereof, respectively. The numerals 0 and 1 of the above described representation "00", "01", "10" and "11" of the data TH correspond to binary logical levels indicating a low state and a high state, respectively. By this thinning-out operation, if the value of the envelope speed data is not changed, a two-fold, four-fold, sixteen-fold and sixty-four-fold increase in the speed of generating the envelope can be achieved. The thinning-out data TH may be varied in accordance with the key touch data obtained in response to the speed and the pressure by which the keys of the keyboard 1 are pressed.

As described above, the ROM 20 stores the processing program for generating and radiating the musical sound and the musical sound data representing the contents or properties of the musical sound, and thus the provision of only a single memory for storing the processing program and the musical sound data in the apparatus simplifies the configuration of the circuits thereof.

3. Key Assigning Circuit 30

Figure 4:
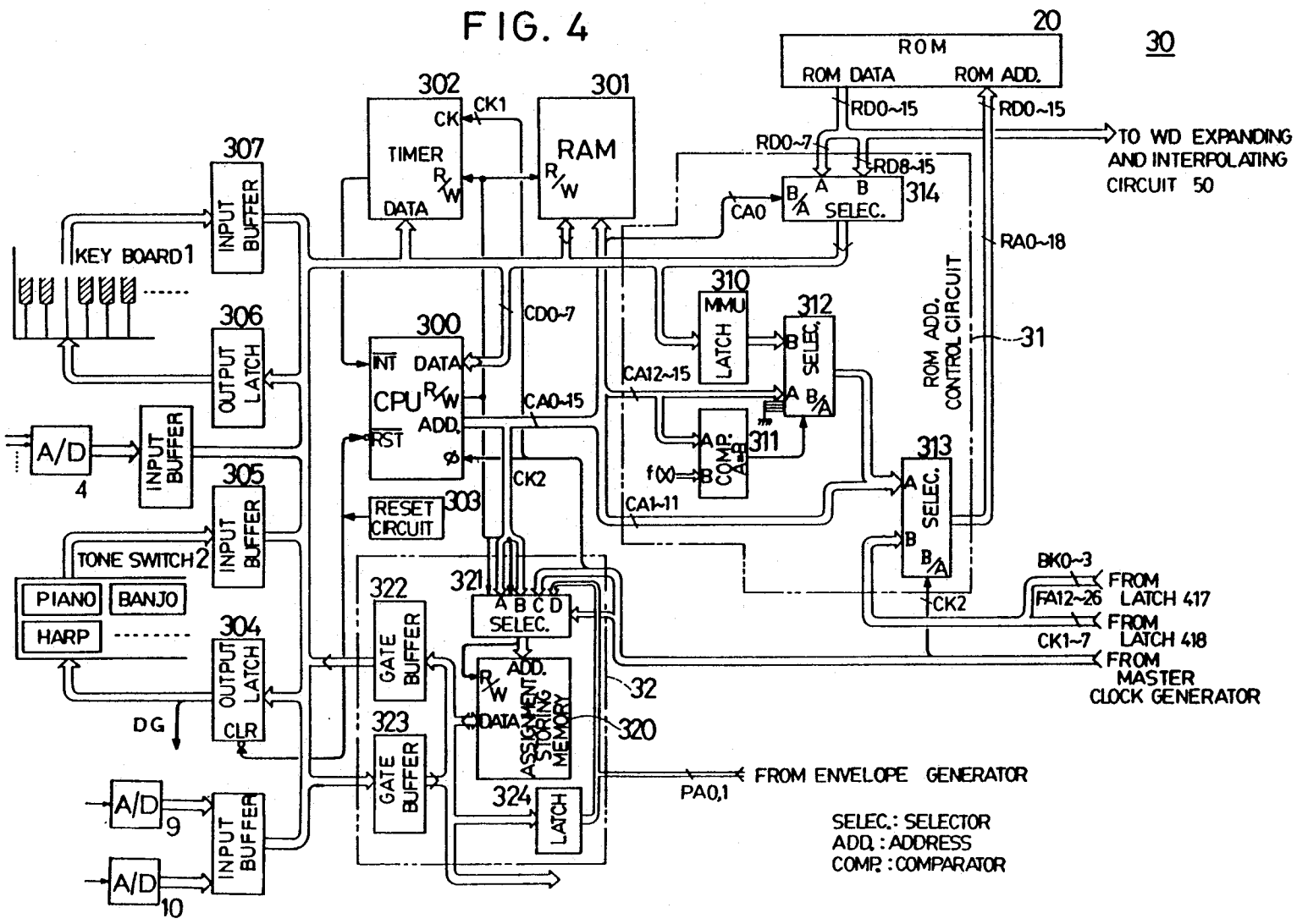
FIG. 4 is a schematic block diagram showing the construction of the key assigning circuit 30.

FIG. 4 is a schematic block diagram showing the construction of the key assigning circuit 30. The CPU 300 shown in this figure is operative only when a master clock signal $\phi$ (CK2) is at a high level. As seen from FIG. 2, data relating to the CPU 300 flows through data and address bus lines only when the master clock signal CK2 is at a high level (corresponding to "1"), and conversely this other data not related to the CPU 300 flows therethough when the master clock signal is at a low level (corresponding to "0").

4. ROM Address Controlling Circuit 31

The address data sent from the CPU 300 for accessing the ROM 20 and other storage devices is represented by using 16 bits CA0-15. As shown in FIG. 4, the data indicated by the low order bits CA1-11, excepting the least significant bit CAO, is supplied to a selector 313. On the other hand, data formed by adding four bits "0000" to the four bits CA12-15 as upper bits thereof is fed to the ROM 20 through the selector 313 as address data represented by using 19 bits together with the lower bits CA1-11, whereby the reading of the processing program is mainly performed. Further, when the CPU 300 reads tone data and so forth other than the processing program, the MMU address data represented by using 8 bits is output through the data bus line, the MMU latch 310 and the selector 312. The MMU address data is further added to the eleven low order bits CA1-11 and supplied to the ROM 20 through the selector 313.

Figure 5:
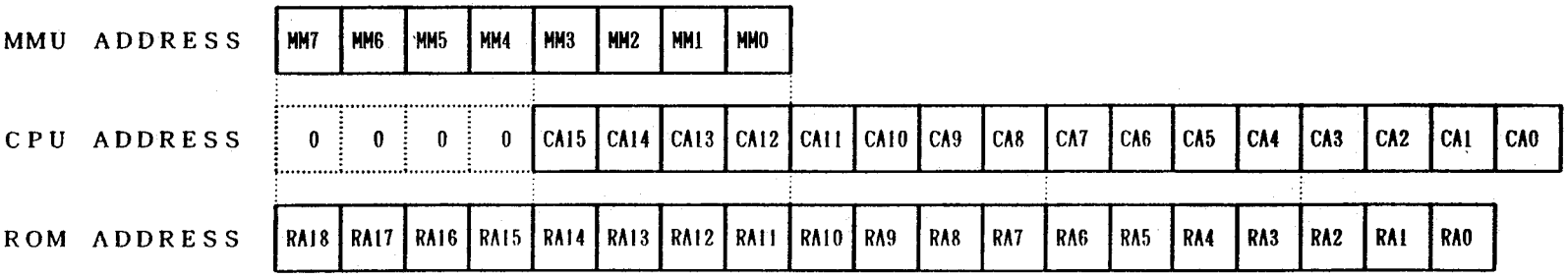
FIG. 5 is a diagram showing the relationship between the address data of a central processing unit 300 and that of a read-only memory 20.

FIG. 5 is a diagram showing such a modification of this data. Although the ROM address data RA0-18 is represented by using 19 bits, the address data CA0-15 (hereinafter referred to as CPU address data) output by the CPU 300 is represented by using 16 bits, and thus, the four bits "0000" and the MMU address data are added to the CPU address data. Further, by selectively adding the MMU address data or the four bits "0000" to the CPU address data, a reading by the CPU 300 from the processing program can be easily changed to a reading from the tone data, and vice versa. Furthermore, even where the CPU address data is represented by using bits having a number less than that of bits used for representing the ROM address data, the whole area of the ROM 20 can be read by such a simple modification of the CPU address data.

Therefore, the CPU 300 can directly access the bank "0", in which processing programs dedicated to the CPU 300, etc., are stored, of the ROM 20 without using the MMU latch 310. Further, if the CPU 300 accesses, for example, the address "$3524_H$" of the bank "1", the value "$13_H$" is set in the MMU latch 310 and the value "$1524_H$" is set therein as the address data of the CPU 300. Accordingly, the synthesized address data is "$13524_H$", and thus the address "$1524_H$" of the bank if "1" can be accessed. In this case, the value "$1_H$," represented by the most significant 4 bits of the address data "$1524_H$" of the CPU 300 is cancelled by the selector 312.

Referring again to FIG. 4, the data represented by the four high order bits CA12-15 is supplied to a comparator 311, to which other data f(x) represented by using four bits is also supplied, and when the former data CA12-15 does not match the latter data f(x), the data formed by the bits "0000" and the address data CA1-2-15 is selected. When a match is made, a coincidence signal is supplied from the comparator 311 to the selector 312, and further, an MMU latch 310 is selected. Therefore, when the address date CA12-15 does not match the data f(x), the processing program to be executed by the CPU 300 is read out of the ROM 20. On the other hand, when a match is made, the tone data and so forth are read therefrom. This data f(x) may be dynamically established by the CPU 300 or preliminarily set as fixed data.

If this f (x) is fixed at "$1_H$", the area is accessed in which the addresses vary from "$1000_H$" to "$1FFF_H$" of the bank "0" of the RAM 20, for the MMU latch 310. On the other hand, if this f(x) is fixed at "$0_H$", the area is accessed in which the addresses vary from "$0000_H$" to "$OFFF_H$" of the bank "0" of the RAM 20.

Figure 2:
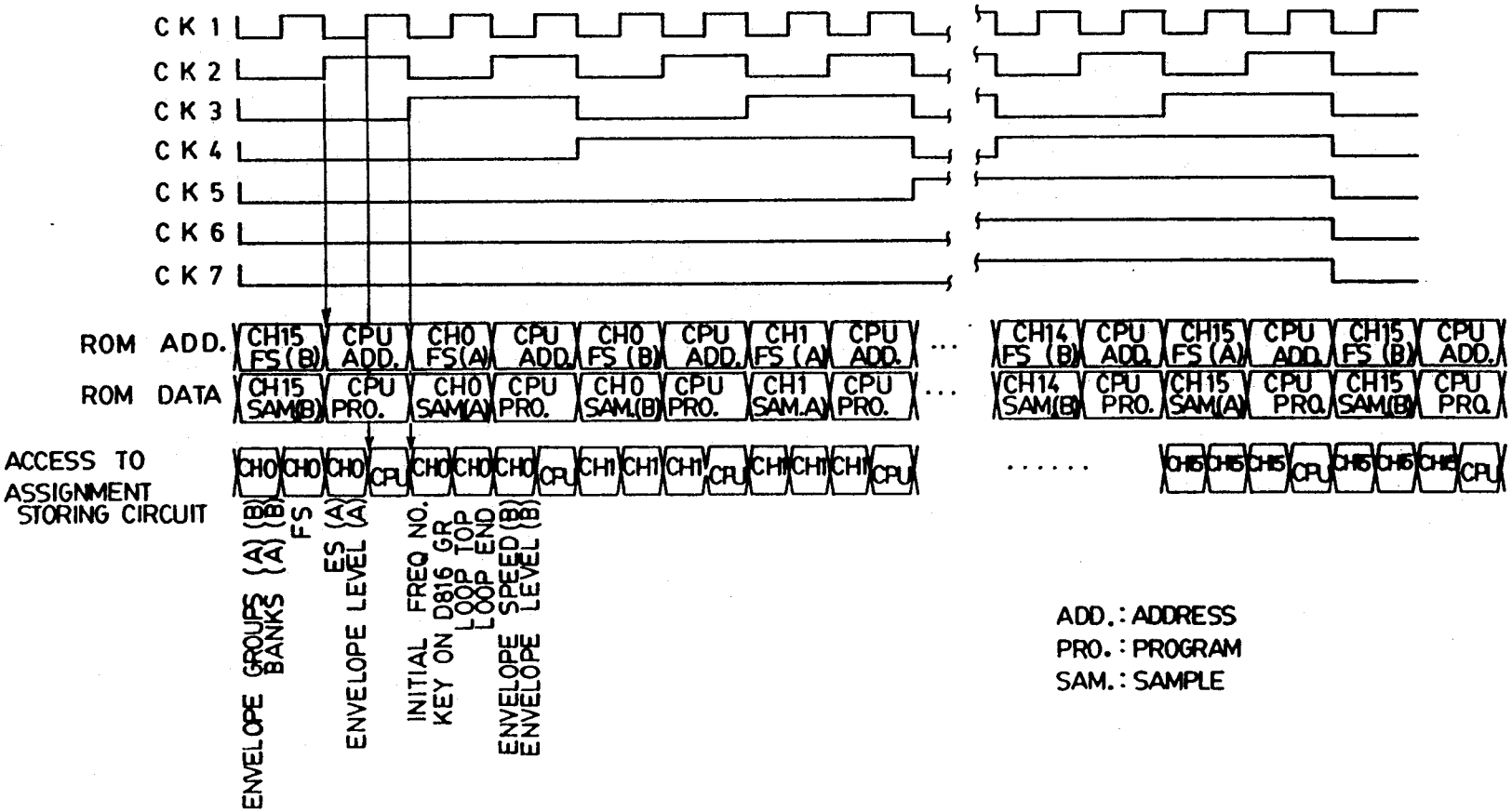
FIG. 2 is a time chart for illustrating the operations of the circuits of FIG. 1 and a key assigning circuit 30.

The bank data read by the CPU 300 from an assignment storing memory 320, which will be described in detail, as well as the values FA12-26 obtained by accumulating the data FS and sent from the FS accumulator 40, is supplied through the selector 313 to the ROM 20 from which the waveform data RD of a corresponding bank is obtained. Further, the above described data selection by the selector 313 is performed on the basis of the clock signal CK2 issued from the master clock generator 10 300, and thus as shown in FIG. 2, the reading from the processing program is changed and a sampled value of the waveform data RD is read and vice versa, in accordance with the ROM DATA signal shown in the lower part of this figure. Where the processing program is read out, the reading from the processing program can be further changed to a reading from the tone data, in accordance with the data f(x). Such a reading operation is repeatedly performed with respect to all of the 16 channels.

Among the data read from the ROM 20, the waveform data RD is sent to the WD expanding and interpolating circuit 50 without change. Conversely, the processing program and the tone data are each bisected into two data, each represented by using 8 bits, which are sent to the CPU 300 through a selector 314 or to the assignment storing memory 320 through a gate buffer 323. The data selection in the selector 314 is effected in accordance with the value of the least significant bit (LSB) CAO of the address data CA sent from the CPU 300, whereby the fetching of the data from the ROM 20 is performed in accordance with the CPU 300. Further, even if the number of bits required to represent the data read out of the ROM 20 is greater than that of bits required to represent data transferred on the data bus line connected to the CPU 300, the data processing can be smoothly carried out.

5. Assignment Storing Circuit 32

FIG. 6 is a diagram illustrating the contents stored in the assignment storing memory 320 of the assignment storing circuit 32. Memory areas for storing the tone data of 16 channels are formed in the assignment storing memory 320, and in each of the memory areas (hereinafter referred to as channel areas), the tone data sent from the ROM 20 is set. In this case, among the tone data to be set therein, the envelope data is set in each corresponding one of envelope group areas EG0-15, and the other data is distributed to and set in each of the channel areas CH0-15. The data to be set in the channel areas CH0-15 is composed of the bank data (A) and (B), the envelope group data (A) and (B), the frequency number speed FS, a "key on" signal data, the data signal D816, the group data GR, the initial frequency number data, the loop top data and the loop end data. Among this data, the data other than the frequency number speed data FS, the "key on" signal data, and the envelope group data (A) and (B) are as described above. The data FS corresponds to a sound pitch represented by the pressed key of the keyboard 1 and is used as data indicating the value of accumulated steps of address data for reading the waveform data RD. The key on signal data indicates that the apparatus is in a "key on" state, i.e. , a key is turned on, and is equal to "1" in the "key on" state and to "0" in a "key off" state in which the keys are turned off. The envelope group data (A) and (B) indicate the addresses of the envelope group areas EG-0-15 in which the envelope data corresponding to the tone data set in the channel areas is stored. Further, two envelope group (A) and (B) exist because the tone data to be assigned to a channel is composed of two data corresponding to two musical sound data. Namely, two corresponding waveform data (A) and (B), and further two corresponding bank data (A) and (B), exist. Note, the envelope data, which is set in the envelope group areas EG0-15, is as described above in the description of the ROM 20.

This frequency number speed data FS is used in common for the two musical tones (A) and (B), and thus the two musical tones (A) and (B) are synthesized and output in response to one operation of the operating key of the key board 1. These musical tones (A) and (B) differ with regard to the corresponding bank data and envelope group data thereof, and thus are different from each other in timbre. Further, the control of the envelopes respectively corresponding to the tones (A) and (B) are separately effected. Namely, the combination of the selected bank data and enveloped group data can be arbitrarily changed by switching and selecting the above described timbre switches 2, and further, the combination of the selected bank data and envelope group data can be changed by changing the magnitude of the touch data TO sent from the pressure sensor 3, the volume data sent f rom the volume knob 7 or the tempo data sent from the tempo knob 8, or by a selection and change of the rhythm keys 5 and the effects keys 6. In this case, other than the bank data and the envelope group data, the timbre may be changed by changing the initial frequency number data, the loop top data, and the loop end data. Moreover, the musical tones synthesized and output by an operation of an operating key are not limited only to the two tone-colors (A) and (B), and may be more than two tone-colors.

The data read out of this assignment storing memory 320 is sent out through an assignment storing memory (AM) bus to the FS accumulator 40 and the envelope generator 60 and so on, and to the CPU 300 through the gate buffer 322. On the other hand, four-bit envelope group data (A) and (B) is again supplied to the assignment storing memory 320 through a selector 321 after the number of bits used for representing data (A) and (B) is increased to 7 by adding phase data represented by using 2 bits as data represented by higher order bits and adding the value "1" represented by using one bit as data represented by a low order bit. Accordingly, the envelope level data EL, the thinning-out data TH, the envelope speed data and so forth, of the corresponding envelope, are read therefrom and sent to the envelope generator 60. The address date represented by a set of clock signals CK sent from the master clock generator 10, as well as the access address data supplied from the CPU 300, are also fed to the assignment storing memory 320.

FIG. 2 shows a time chart illustrating such a modification of the address data at the bottom thereof. First, the envelope group data (A) and (B) the bank data (A) and (B) and the frequency number speed data FS are read out of the memory 320, in this order, on the basis of the set of clock signals CK. Then the envelope speed data (A) ES and the envelope level data (A) EL are read therefrom on the basis of the envelope group data (A) and the phase data PA, and therefore, the CPU 300 is accessed. Following the access to the CPU 300, the initial frequency number data, the "key on" signal data, the data length signal data D816 and the group data GR are read out of the memory 320 on the basis of the set of the clock signals CK, and thereafter the loop top data and the loop end data are read. Then the envelope speed data (B) ES and the envelope level data (B) EL are read from the memory 20 on the basis of the envelope group data (B) and the phase data PA, and therefore, the CPU 300 is once more accessed. The above described process is repeatedly performed with respect to the data assigned to the 16 channels.

In this case, the signals CK1-7 of FIG. 2 are employed as the set of the clock signals CK used for representing the address data which indicates the data to be read. The selection of each address data is effected by the selector 321 on the basis of the clock signals CK1 and CK2. When 2-bit data, the value of the leftmost bit of which is represented by the clock signal CK2 and that of the rightmost bit which is represented by the clock signal CK1, is "00" or "01", the set of the clock signals CK are selected as the address data. Further, when the 2-bit data is "10", the envelope group data and the phase data PA are selected as the address data. In addition, when the 2-bit data is "11", the address data sent from the CPU 300 is selected.

Data to be used in various intermediate processing is stored in a random-access memory (RAM) 301, and a timer 302 supplies interrupt signals to the CPU 300 at intervals established by the CPU 300. A reset circuit 303 operates to reset the CPU 300 and an output latch 304 when the power is turned on. The sampling addresses of the keyboard 1 and the tone switch 2 are temporarily stored in the output latch 304 and another output latch 306. Further, the results of the sampling are input to input buffers 305 and 307. Note, a signal representing date of only a single bit of the sampling data set in the output latch 304 is used as a gate signal for the DA converter 100.

6. FS Accumulator 40

Figure 7:
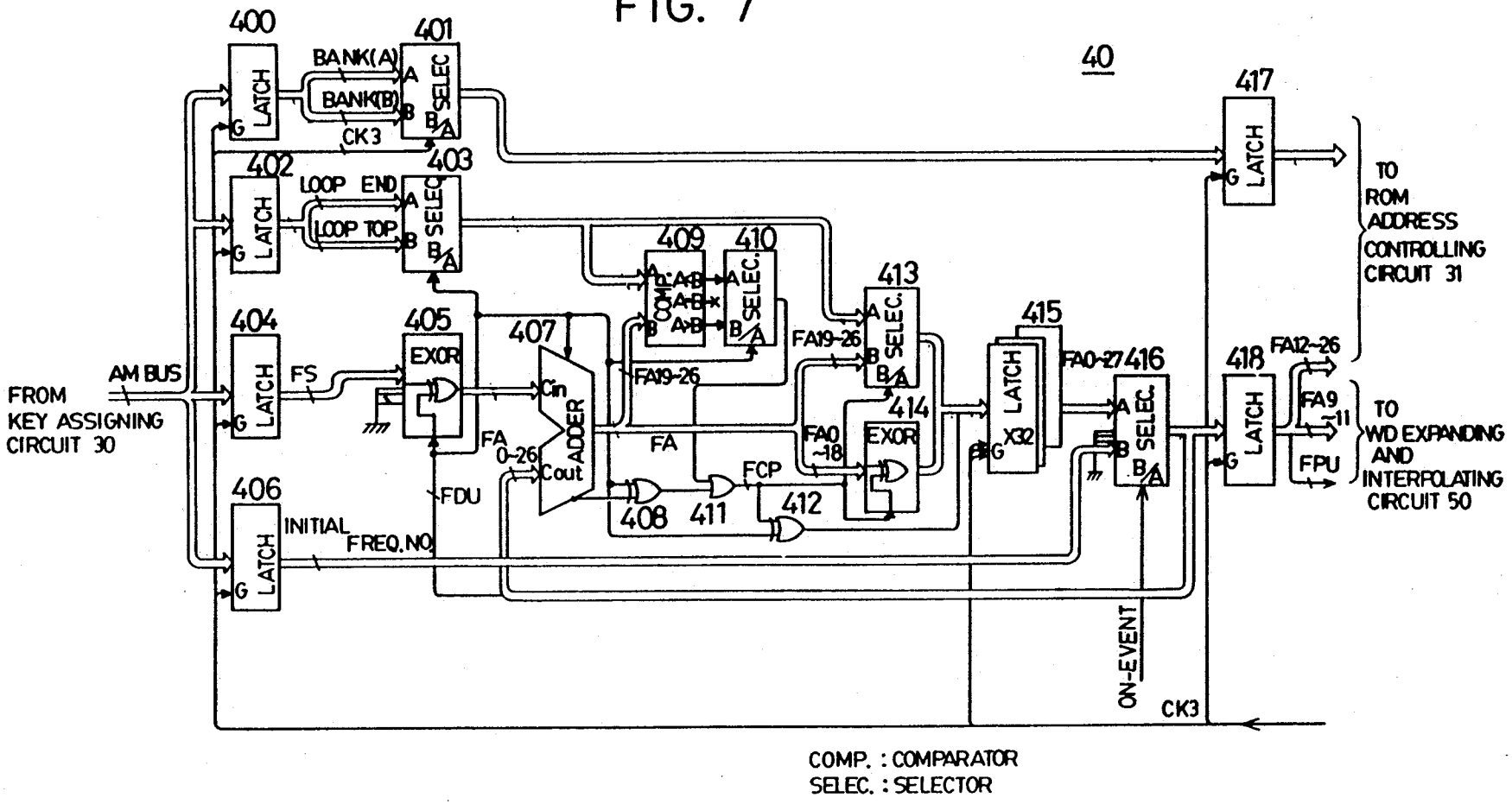
FIG. 7 is a schematic block diagram showing the construction of a frequency number speed data accumulator 40.

FIG. 7 is a schematic block diagram showing the construction of the FS accumulator 40. The data FS represented by the signals sent from the assignment storing circuit 32 is transferred through a latch 404 and an EXCLUSIVE-OR (hereinafter abbreviated as EX-OR) gates 405 to adder 407, whereupon the FS data is accumulated, i.e., added to the accumulated value FA, the 8 high order bits FA19-26 of which are transferred through a selector 413 to, and the 19 low order bits FA0-18 are sent through a group of EX-OR gates 414 to a group of latches 415. Then the data represented by these bits FA0-26 is supplied through the group of latches 415 and a selector 416 to the adder 407 as the accumulated value FA. Accordingly, the values FA are accumulated at a speed corresponding to the magnitude of the data FS, and further, the 15 high order bits FA12-26 (corresponding to an integer part) of the accumulated value FA are sent to the ROM address controlling circuit 31 through a latch 418, to thereby read the waveform data RD. On the other hand a signal indicating data represented by the 3 high order bits FA9-11 of a fraction part of the value FA and the waveform folding signal indicating data represented by the most significant bit (MSB) of the value FA are sent to the WD expanding and interpolating circuit 50, whereupon the expansion and interpolation of the samples of the data RD are effected by using the data represented by the bits FA9-11 and MSB.

Figure 9:
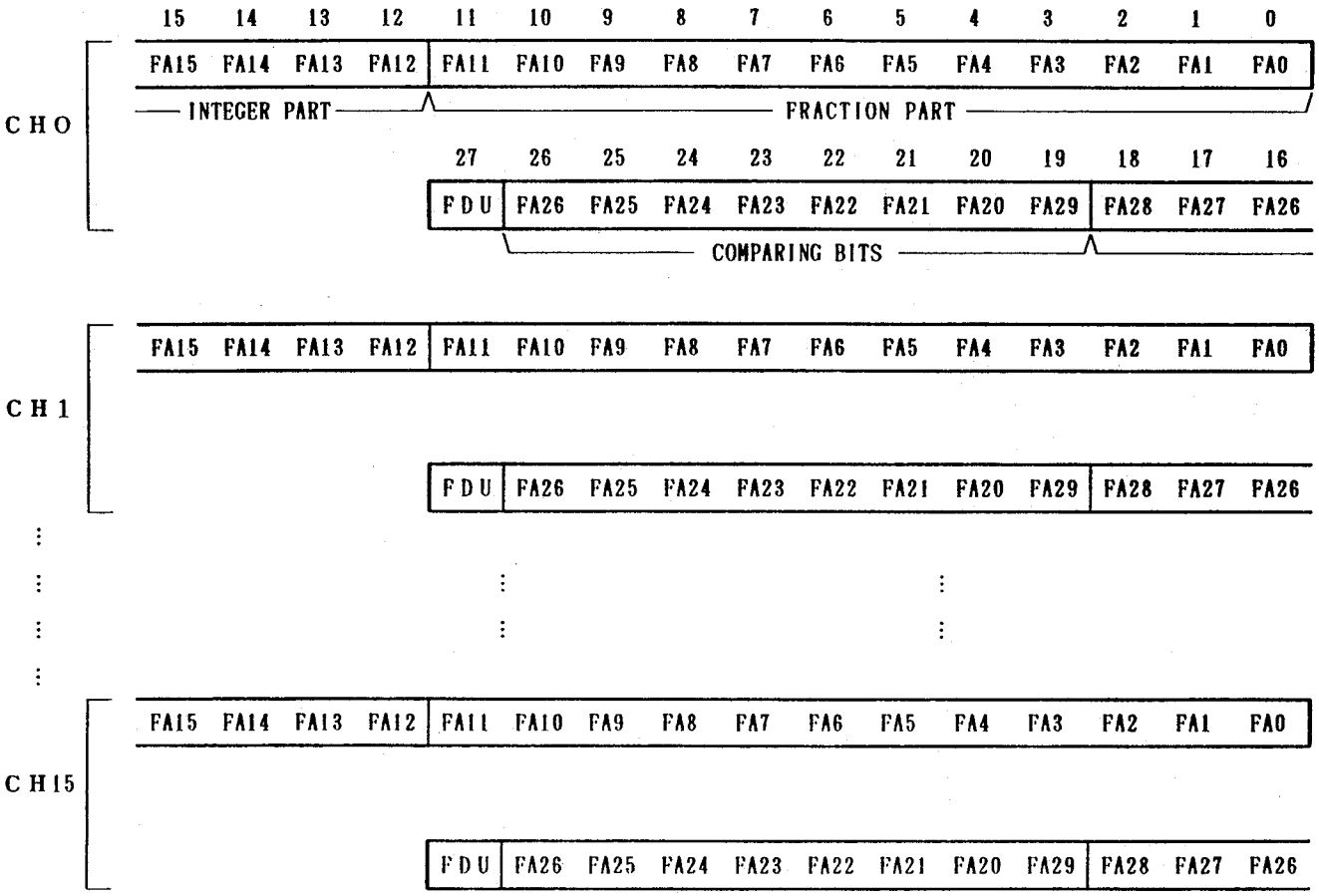
FIG. 9 is a diagram showing the contents of the accumulated value FA of the frequency number.

FIG. 9 is a diagram showing the contents of the value FA, which is represented by using 28 bits. The value at the MSB is represented by the waveform folding signal FDU. Further, the high order bits FA19-26 are comparing bits representing data to be used for comparisons made to determine whether or not the value FA has reached the turning points indicated by the loop top or loop end data, the intermediate order bits FA12-18 indicate an integer part of the value FA, and the low order bits FA0-11 indicate a fraction part of the value FA. The data FS of the 16 channels CH0-15 is accumulated in the FS accumulator 40, and the value FA corresponding to each channel is stored in the group of the latches 415. This group of latches 415 is composed of 16 latches, wherein the latches in which the accumulation of the frequency number speed data is effected are switched at the time determined by the clock signal CK3. Further, the reading of the latch is effected during one cycle of the clock signal CK3, and on the other hand, the writing of the latch is effected at the last part of a second half of a cycle of the clock signal CK3. As for the two musical tone components (A) and (B), the same reading addresses (i.e., the same accumulated frequency numbers FA12 to FA26) are set to each latch of this group 415. The difference in tone color is due to the difference between the bank data (A) and (B).

The assignment storing memory 32 sends a signal indicating the initial frequency number data through a latch 406 to the selector 416, whereupon the data "0" represented by using 1 bit is added to the left side of the MSB of the initial frequency number and the data "00 . . . 00" represented by using 19 bits is added to the right side of the LSB of the initial frequency number. The data obtained by thus modifying the initial frequency number is selected by the selector 416 as data represented by 28 bits, similar to the value FA. As a selection signal issued from this selector 416, the "on-event" signal output from the envelope generator 60 at the time of starting a "key on" state is used. As shown in FIG. 8, the data FS is sequentially accumulated or added to the initial frequency number from the time of starting a "key on" state (corresponding to the origin of the graph of this figure).

Further, the loop top data and the loop end data are sent from the assignment storing memory 32 through the latch 402 to the selector 403, whereupon one of the loop top data and the loop end data is selected. The thus selected data is transferred from the selector 403 to a comparator 409 and the selector 413. In the comparator 409, the selected data is compared with the comparing bits (i.e. , the 8 high order bits FA19-26 of the value FA) , and if the value FA is not within the range between the loop top data and the loop end data, the selector 410 outputs an overrun signal FCP to the group of EX-OR gates 414 and to the selector 413, through an OR gate 411, and the loop top data or the loop end data is replaced by data represented by the comparing bits FA19-26, i.e. , is taken into the accumulator 40 as new data. At that time, in the group of EX-OR gates 414, the sign of the integer part and the fraction part of the value FA is inverted, so that a fraction of the current value FA at a turning point can be used simply by changing the sign thereof when reading the waveform data RD of the next half cycle, in which the sign of the waveform data RD is inverted, to properly coordinate the reading operations of the current and the next half cycles.

The overrun signal FCP is also supplied to an EX-OR gate 412, to invert the waveform folding signal FDU indicating the MSB of the value FA, whereby the sign of the value of the data FS in the group of the EX-OR gates 405 is changed, and the operation of the adder 407 is changed from one of the adding and the subtracting operations to the other thereof with respect to the data FS. FIG. 8 shows how the reproduction of the waveform data RD is performed by changing the operation of the adder 407 from one of the adding and the subtracting operations to the other thereof at each half cycle.

The waveform folding signal FDU is supplied to the selectors 403 and 410 as a selection signal. When performing are addition of the data FS, the signal representing the loop end data and an "A<B" event detecting signal are selected. Conversely, when performing a subtraction of the data FS, the signal representing the loop top data and an "A>B" event detecting signal are selected. The signal FDU is also input to the adder 407 at a $C_{in}$ terminal thereof, whereupon the value FA is incremented by 1 when performing a subtraction of the data FS. Further, the signal FDU is fed to an EX-OR gate 408 to which an output signal is sent from a $C_{out}$ terminal of the adder 407, to thereby detect an overflow or an underflow in the calculation of the value FA. At that time, the overrun signal FCP is output from the OR gate 411.

Furthermore, the bank data (A) and (B) are sent from the assignment storing memory 32 through a latch 400 to the selector 401, whereupon one of the data (A) and (B) is selected. The selected data is sent from the selector 401 through a latch 417 to the ROM address controlling circuit 31, whereby the reading of the waveform data RD is performed.

Therefore, with regard to the two musical sound data components (A) and (B) assigned to a channel, the bank data is different but the common value FA is used to synchronize the processing of the generation of musical sounds.

Further, the clock signal CK3 is output from the master clock generator 10 as the selection signal input to the selector 401 indicating the selected data. The processing of generating the musical sound (A) is effected in a first or former half cycle of the clock signal CK3, and the processing of generating the musical sound (B) is performed in a second or latter half cycle thereof.

The group of the clock signals CK is supplied to the latches 400, 402, 404, 406, 415, 417 and 418 as a latch signal to obtain a channel synchronization and to synchronize the musical sound generating processing.

7. WD Expanding and Interpolating Circuit 50

Figure 10:
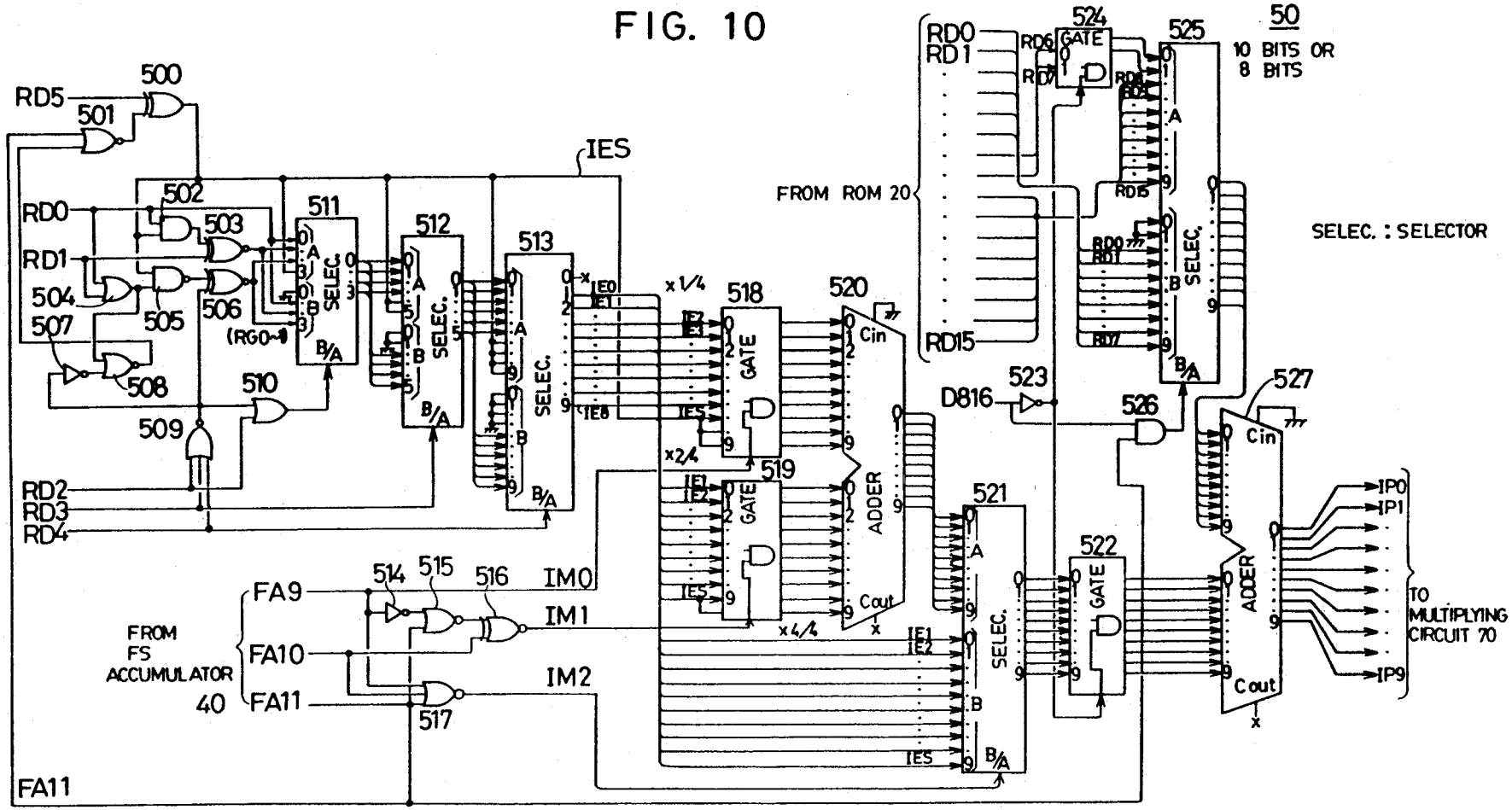
FIG. 10 is a circuit diagram showing the construction of a waveform data expanding and interpolating circuit 50.
Figure 12:
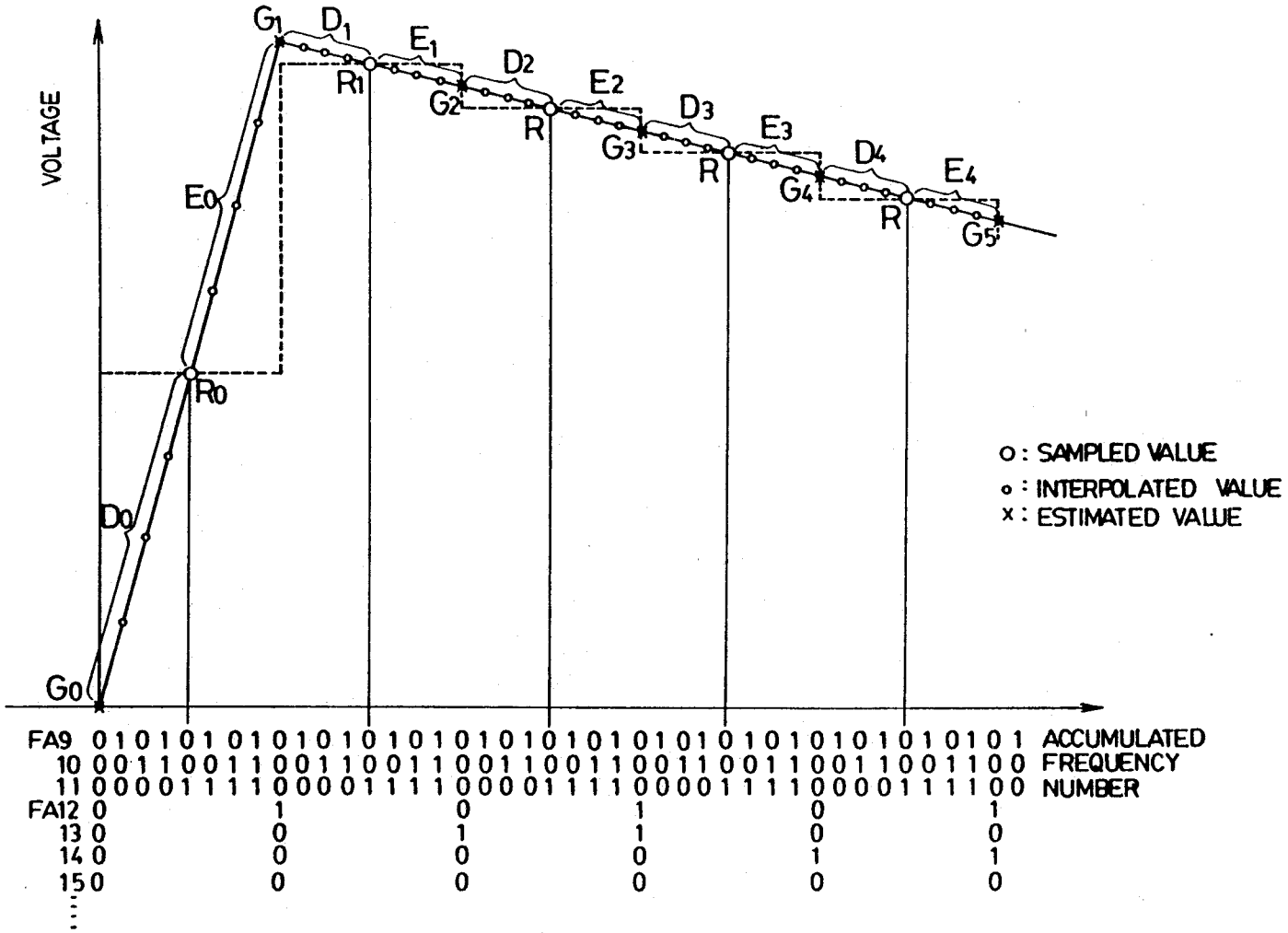
FIG. 12 is a graph showing the relationship between the sampled values and interpolated values of the waveform data.

FIG. 10 is a circuit diagram showing the construction of the WD expanding and interpolating circuit 50. The expansion of difference data of the waveform data RD as shown in FIG. 14 is effected by gates 500-510 and selectors 511-513, and further, the interpolation of sampled values $R_O$, $R_1$, $R_2$ and $R_3$ . . . of the waveform data RD as shown in FIG. 12 is effected by gates 514-517, groups of gates 518 and 519, an adder 520, and a selector 521. Furthermore, where the waveform data RD is composed of the sampled value represented by using 10 bits and the difference data represented by 6 bits (D816 = "0" (corresponding to a low level "L")), the interpolation is effected by groups of gates 524 and 522, a gate 526, a selector 525, and an adder 527. Conversely, the interpolation is not effected where the data RD is composed of two sampled values represented by 8 bits (D816 = "1" (corresponding to a high level "H")).

7.1 Outline of Data Processing Effected by Circuit 50

Figure 13:
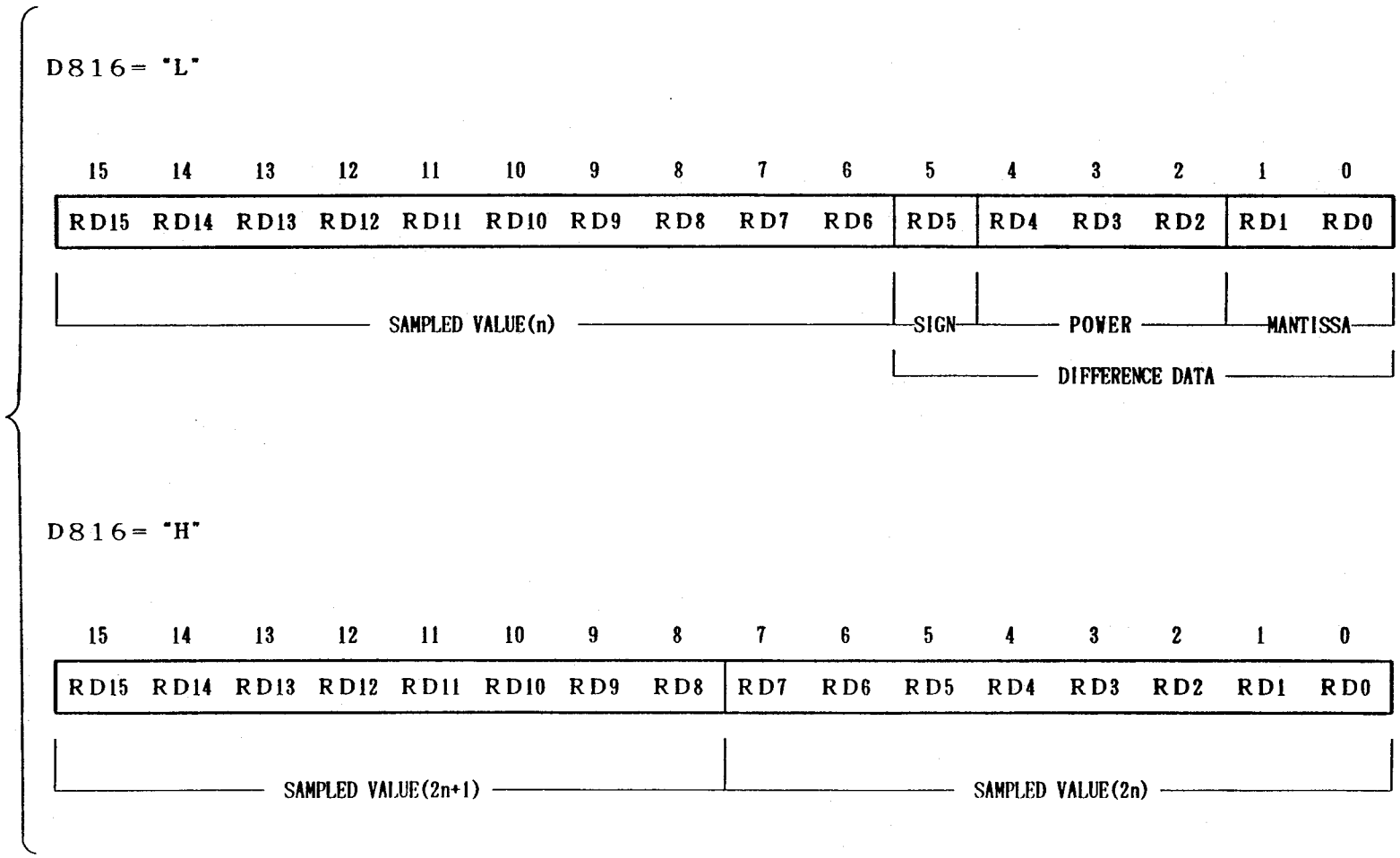
FIG. 13 is a diagram showing the contents of the waveform data RD.

FIG. 13 is a diagram showing the contents of the waveform data read out of the ROM 20. When the data length signal D816 has a low level "L" (corresponding to "0") and the data RD is composed of a sampled value represented by using 10 bits and a difference data represented by using 6 bits, 10 high order bits RD6-15 indicate the sampled value; a bit RD5, the sign of the difference data; bits RD2-4, the power of the difference data; and bits RD0-1, the mantissa of the difference data. The difference data RD0-4 is compressed and stored, and an expansion of the compressed difference data provides an expanded difference data IE0-8 and IES represented by using 10 bits as shown in FIG. 14. Namely, the data of the power (hereinafter referred to as the difference power data) RD2-4 indicates the order of a bit, at which "1" first appears, of the difference data. Further, the data of the mantissa (hereinafter referred to as the difference mantissa data) represented by 2 bits RD0-1 indicates the data per se stored in the 2 bits following the first appearing "1". Namely, the data format shown in FIG. 14 (A) is used when adding the expanded difference data. On the other hand, the data format shown in FIG. 14 (B) is used when subtracting the expanded difference data, and in this case, the data of the power RD2-4 indicates the order of a bit, to which "1" appears from the LSB, of the difference data. The converted difference mantissa data RG0-2 following this is obtained by converting the difference mantissa data by using the logical expressions shown at the bottom of FIG. 14 (B). The results of this conversion are equivalent to data obtained by changing the sign of the difference data as shown in FIG. 15. This expanded difference data IE0-8 and IES is equivalent to one-half of the difference between two adjacent sampled values of the waveform data RD indicated by the larger white circles in FIG. 12, and thus indicates the difference between the sampled value and an adjacent estimated value indicated by a saltire in this figure. In this figure, saltires indicating the estimated values overlap with the smaller white circles indicating the values obtained by interpolating the sampled values.

The sampled values $R_0$, $R_1$, $R_2$. . . of the waveform data RD are obtained where the fraction part of the value FA is equal to one-half. Therefore, to realize the waveforms indicated by saltires in FIGS. 11 (B) and 12, it is only necessary to store the sampled values $R_0$, $R_1$, $R_2$. . . at points midway between the points at which the sampled values are $G_0$, $G_1$, $G_2$. . . indicated by saltires. Therefore, the sampled values $R_1$, $R_1$, $R_2$ . . . are obtained by the following equations: $R_0=(G_0+G_1)/2$; $R_1=(G_1+G_2)/2$; $R_2=(G_2+G_3)/2$, . . .

Figure 11:
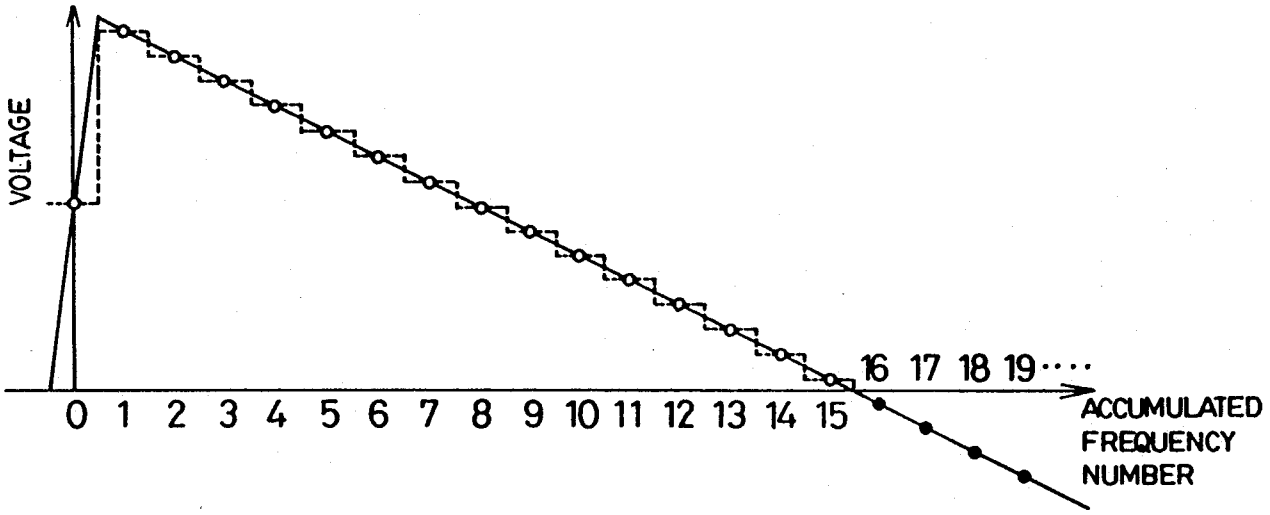
FIG 11A, 11B is a graph showing the relationship between the sampled values of the waveform data of a half-wavelength and an accumulated frequency number.
Figure 11:
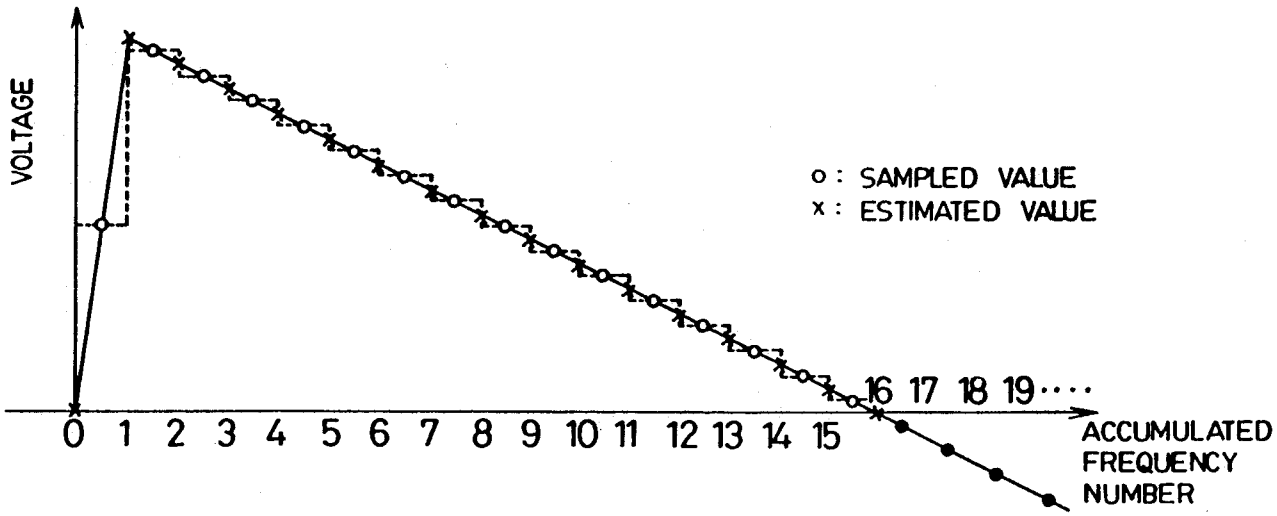

By storing the sampled vales $R_0$, $R_1$, $R_2$ . . . at the points midway between the points indicated by saltires, instead of storing the sampled values $G_0$, $G_1$, $G_2$ . . . at the points indicated by saltires, the level of the waveform data RD is precisely adjusted to 0 at a starting point at which the value FA is equal to "0000" as shown in FIGS. 11 (B) and 12. Namely, although the level, which is not equal to 0, of the first step of the waveform data RD is usually stored at the top or leading address of the memory area of the ROM 20 used for storing the waveform data RD, the level of the waveform data can be automatically adjusted to 0 at the origin at which the value FA is "0000", without preventing the reading of the non-zero date of the first step, and thus the difference in level of the waveform data at the origin as shown in FIG. 11 (A) does not occur.

Further, the difference in level of the data RD between a midway point, which is present between the adjacent points indicated by saltires, and an interpolated point just prior to the midway point, is equal to that in the level between the midway point and another interpolated point just after the midway point, and as a result, the difference data to be stored can be reduced to one-half of the original difference data. Usually, when the sampled value of the data RD is represented by using 10 bits, the difference data is also represented by using 10 bits. Therefore, even if the above described compressing method is used, 4 bits are necessary for representing the difference power, and thus the compressed difference data is represented by using at least 7 bits. As stated above, in this embodiment however, the difference data can be reduced to one-half thereof, i.e. , the number of bits required to represent the difference data can be reduced to 6 bits, and thus the total number of bits representing the sampled value of the data RD and the difference data can be reduced to 16 bits and can be accessed at a time of a usual access to data.

Therefore, if the number of times of reading the waveform data RD per unit time is reduced to one-half thereof by alternately reading the data RD and the processing program (or the tone data) from a single ROM 20, the apparatus of the present invention can provide a satisfactory performance.

Note, the waveform indicated by the data RD to be stored may be shaped such that the points representing the estimated values as indicated by saltires in FIGS. 11 (B) and 12, can be connected by polygonal lines.

Further, the value obtained by multiplying the expanded difference data by $\frac{1}{4}$ (2/4, $\frac{3}{4}$ or 4/4) is added (in an addition mode) to or subtracted (in a subtraction mode) from a sampled value as shown in FIG. 16, to thereby obtain an interpolating value. At that time, if as shown in FIG. 12 the interpolated values $E_0$, $D_1$, $D_2$, $D_3$ . . . , are greater than the corresponding sampled values $R_0$, $R_1$, $R_2$, $R_3$ . . . , the expanded difference data is added to the sampled values as shown in FIG. 14 (A) . Conversely, if the interpolated values $D_0$, $E_1$, $E_2$, $E_3$ . . . are greater than the corresponding sampled values $R_0$, $R_1$, $R_2$, $R_3$ . . . expanded difference data is subtracted from the sampled values as shown in FIG. 14 (B).

Note, there are two kinds of data formats; one which uses 10 bits and the other which uses 8 bits, for representing the waveform data RD. The latter data format using 8 bits is employed in the case of a noisy sound in which it does not matter if quantizing noise occurs when the number of bits used for quantization is reduced. Conversely, the former data format using 10 bits is employed in the case of sounds in which it does matter if the quantizing noise occurs. Accordingly, the memory area can be substantially reduced.

7.2 Construction of WD Expanding and Interpolating Circuit 50

Referring to FIG. 10, the difference mantissa data RDO are input to the selector 511 at the "0" terminal of the group A and at the "1" terminal of the group B, without change. Further, at the "1" terminal of the group A and the "2" terminal of the group B, the difference mantissa data RD1 is input without modification when the value IES represented by the MSB indicates "0". Conversely, when the value IES represented by the MSB indicates "1", an AND gate 502 is enabled and the EX-OR data RG1 of the difference mantissa data RDO and RD1 is input therefrom. Furthermore, when the value IES represented by the MSB indicates "0", an output of a NAND gate 505 becomes "1" and an output of the NOR gate 509 is inverted by an EX-OR gate 506, and thus the logical sum of the difference power data RD2–4 is input to the "2" terminal of the group A and the "3" terminal of the group B. Conversely, when the value IES represented by the MSB indicates "I", the EX-OR data RG2 of the inverted logical sum of the difference mantissa data RD0 and RD1 and the inverted logical sum of the difference powers data RD2–4 are input therefrom. Further, the data IES represented by the MSB is input to the "3" terminal of the group A of the selector 511, and the data "0" is input to the "0" terminal of the group B thereof, whereby data composed of the difference mantissa data RD0,1 and data represented by a higher order bit, or the converted difference mantissa data R0, 1 and 2, the contents of which are shown in FIG. 15, are generated.

The data represented by 2 bits, each indicating the value represented by the MSB IES, is added by a selector 512, and the data represented by 4 bits, each indicating the value IES, is added by a selector 513 to the 4-bit data of this selector 511 as the data represented by higher order bits than the MSB of the 4-bit data. Alternatively, the data represented by 2 bits, each indicating "0", is added by a selector 512, and the date represented by 4 bits, each indicating "0", is added by a selector 513 to the 4-bit data of this selector 511 as the data represented by lower order bits than the LSB of the 4-bit data. Therefore, 10-bit data formed by thus modifying the 4-bit data of the selector 511 is output from the selector 513 as 10-bit data. By appropriately selecting the selecting condition of each of selectors 511, 512, and 513 in accordance with the difference power data RD2–4, the difference mantissa data RD0,1 or RG0–2 can be shifted as shown in FIG. 14.

Accordingly, the compressed difference data is represented by only 6 bits, but the difference data can be expanded such that the expanded data is represented by using 10 bits, thereby reducing the memory area.

The value of the MSB IES of the difference data to be expanded is determined by the difference sign data RD5 input to the EX-OR gate 500, that indicated by the MSB FA11 of the fraction part of the value FA input to the NOR gate 501, and that indicated by the logical sum, the sign of which is changed, of the bits RD0–4 of the difference data from the NOR gate 508. Namely, as shown in FIG. 12, when the bit FA11 of the value $D_O$ is "0" and the difference sign data represented by the bit RD5 is "0" (i.e., in the addition mode), or when the bit FA11 of each of the values $E_1$, $E_2$, . . . is "1" and the bit RD5 is "1" (i.e., in the subtraction mode), the MSB IES of the difference data is "1", and this indicates that the difference data is to be subtracted from the sampled value. The logical sum, the sign of which is changed or inverted, of bits RD0–5 of the difference data is input to the NOR gate 501. Further, where that the difference data is "00000", an output of the NOR gate 501 is made "0", so that the bit IES does not become "1".

The expanded difference data IE is shifted to the right by 1 bit, i.e. , reduced to 2/4 thereof, and then input to a group of terminals of the adder 520 through a group of the AND gates 519. Simultaneously, the data IE is shifted to the right by 2 bits, i.e., reduced to $\frac{1}{4}$ thereof, and further input to the other group of terminals of the adder 520 through a group of the AND gates 518. Therefore, an output of this adder 520 is supplied to the terminals of the group A of the selector 521. On the other hand, the unshifted data IE is supplied, while the value thereof is unchanged, to a group of terminals of the group B of the selector 521. Therefore, the expanded difference data IE can be changed by factors of $\frac{1}{4}$, 2/4, $\frac{3}{4}$, 4/4 and 0 by suitably selecting magnification data IM represented by signals IMO and IMI, which are enable signals for the groups of the AND gates 518 and 519, respectively, and a signal IM2, which is a selection signal for the selector 521.

The thus changed difference data IE is supplied to the adder 527 through the group of the AND gates 522 and is added to or subtracted from the sampled values RD6–15 of the waveform data RD, which will be described later, whereby the interpolation of the sampled values of the waveform data RD is performed.

Therefore, the waveform data RD having 8 positions can be generated from a sampled value represented by the bits RD6–15 and the difference data represented by the bits RD0–5. Further, a smooth waveform can be obtained, and the memory capacity can be reduced, and in addition, the waveform data RD, a single data of which enables a determination of the levels of the waveform at 8 positions at a time, can be read out at once. Therefore, even if the number of times of reading the waveform data RD is low, a sufficiently smooth waveform can be realized, and consequently, if the waveform data RD and other information such as programs are alternately read out of the ROM 20, the processing of generating the waveform can be performed without hindrance. Furthermore, if the program and the waveform data are stored together in the ROM 20, there is no need to increase the rate of reading the various information.

The magnification data IM0–2 is generated by the logical gates 514–517 from the 3 high order bits FA9–11 of the fraction portion of the value FA, and the groups of gates 514 and 517 performs the conversion of the data as illustrated by FIG. 16 to obtain the interpolated values of the waveform data RD. In this case, if only the MSB FA11 of the fraction part of the value FA is "1", i.e., the value FA is equal to $\frac{1}{2}$, the interpolation of the sampled values is not effected. Further, prior to that time, the interpolated values are obtained by subtracting $\frac{1}{4}$, 2/4 and $\frac{3}{4}$ of the difference data from the value FA. Conversely, after that time, the interpolated values are obtained by adding $\frac{1}{4}$, 2/4 and $\frac{3}{4}$ of the difference data to the value FA.

Where the waveform data RDO–15 is composed of a sampled value represented by using 10 bits and a difference data represented by using 6 bits, the sampled value RD6–15 is input to the group A of the selector 525 and are then supplied to the adder 527 without modification, to calculate the interpolated values. At that time, the data length signal D816 indicates "0", and thus the groups of the AND gates 524 and 522 are enabled and the AND gate 526 is disabled, and in addition, the group A of the selector 525 is selected. Where the waveform data RDO-15 is composed of two sampled values each represented by using 8 bits, a portion of the waveform data RDO–7 is input from the group B of the selector 525 and then supplied to the adder 527, and another portion of the waveform data RD8–15 is input from the group A of the selector 525 and is thereafter supplied to the adder 527. At that time, two bits "00" are added to each of the data RDO-7 and RD8-15 as the lower order bits than the LSB of each data, to thereby change the data into 10-bit data. Furthermore, at that time, the data length signal D816 indicates "1", and thus the groups of the AND gates 524 and 522 are disabled and the interpolation of the waveform data RD is not performed. Further, the AND gate 526 is then enabled, and thus the sampled values represented by the bits RDO-7 and RD8-15 are switched in accordance with the value "1" or "0" of the MSB FA11 of the fraction part of the value FA.

8. Envelope Generator 60

Figure 17:
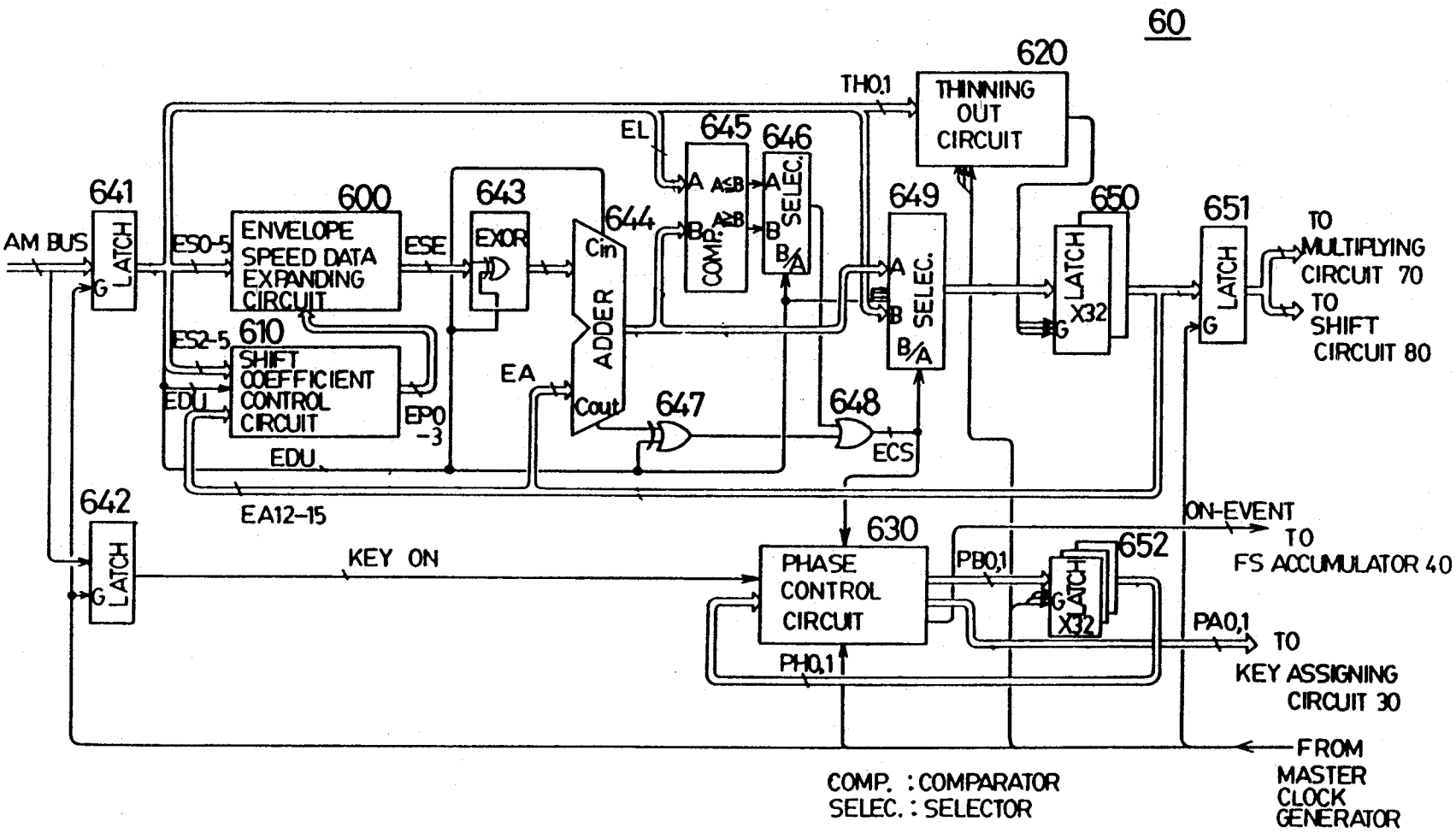
FIG. 17 is a circuit diagram showing the construction of an envelope generator 60.

FIG. 17 is a schematic block diagram showing the construction of the envelope generator 60. The envelope speed data ESO-5 sent from the assignment storing memory 32 is supplied through a latch 641 to the envelope speed data expanding circuit 600, whereupon the expansion of the data ESO-5 as shown in FIG. 22 is performed. The thus-expanded data ESE is sent from the circuit 600 through a group of EX-OR gates 643 to an adder 644, whereupon the data ESE is added to the accumulated envelope value EAO-15. Then an output of the adder 644 is sent through a selector 649 to a group of latches 650, and thereafter, signals of the group of the latches 650 are returned back to the adder as a signal indicating the value EAO-15 and are output through a latch 651 to the multiplying circuit 70 and the shift circuit 80. The group of latches 650 is composed of 32 latches in which 32 envelope accumulated values EA corresponding to 16 timbres per each of the two musical tones (A) and (B) can be accumulated.

The envelope add-subtract signal EDU for selecting one of the addition of the expanded envelope speed data ESE to the accumulated envelope value EA and the subtraction of the expanded envelope speed data ESE from the value EA is supplied to a group of EX-OR gates 643. When the expanded subtraction is selected, the sign of the data ESE is changed, and thereafter, the changed data ESE is supplied to an adder 644 and the subtraction of the data ESE is effected. The seven high order bits of the value EA from the adder 644 are fed to a comparator 645 and compared with the envelope level data EL of an attack phase, a decay phase, a sustain phase or a release phase, as shown in FIG. 24. If the value EA exceeds the envelope level data EL, a phase advancing signal ECS is supplied through a selector 646 and a NOR gate 648 to the selector 649. Therefore, the data obtained by adding the 9-bit data, the value of which is equal to that indicated by the signal EDU, to the data EL as lower order bits than the LSB of the data EL is newly selected as the value EA, and thus at the starting point of the next phase the value EA is modified to produce a precise value of the data EL.

The envelope add-subtract signal EDU for selecting the addition or the subtraction of the data ESE is used as a selection signal of the selector 646. If the addition is selected, the time when the value EA becomes equal to or greater than the data EL is detected, and further, if the subtraction is selected, the time when the value EA becomes equal to or less than the data EL is detected. An outpout of the adder 644 from a Cout terminal thereof and the signal EDU are input to an EX-OR gate 647. In this case, the phase advancing signal ECS is also output from the gate 648, and thus the processing advances to the next phase even if the accumulated envelope value overflows or underflows.

This transition of the phase is effected by a phase control circuit 630, and thus the phase control circuit 630 enters the attack phase in accordance with a key on signal fed from the latch 642. Thereafter, every time the phase advancing signal ECS is supplied to the phase control circuit 630, the phase of the circuit is advanced to the next phase, i.e., the decay phase, the sustain phase and the release phase, in this order. At the transition of the phase, the phase control circuit 630 instructs the assignment storing memory 32 of the key assigner 30 to read the envelope data of the next phase. Note, when maintaining a current phase, the maintenance of the current phase is effected by the group of the latches 652.

The expansion of the compressed envelope speed data ES in the envelope speed data expanding circuit 600 is effected by performing the shift control in accordance with shift coefficient data EPO-3 sent from a shift coefficient control circuit 610. This shift coefficient data EPO-3 is produced on the basis of the four high order bits ES2-5 of the envelope speed data, the four high order bits EA12-15 of the accumulated envelope value, and the envelope and subtract signal EDU.

The thinning-out data THO, I from the assignment storing memory 32 is fed to the thinning-out circuit 620, which controls the thinning of the times of latching of the accumulated envelope values in the group of the latches 650. The clock signals are supplied to the thinning-out circuit 620, the phase control circuit 630, the group of latches 652 and latches 641, 642 and 651, to effect the channel synchronization and the synchronization of the musical sound generating processing.

8.1 Envelope Speed Data Expanding Circuit 600

Figure 18:
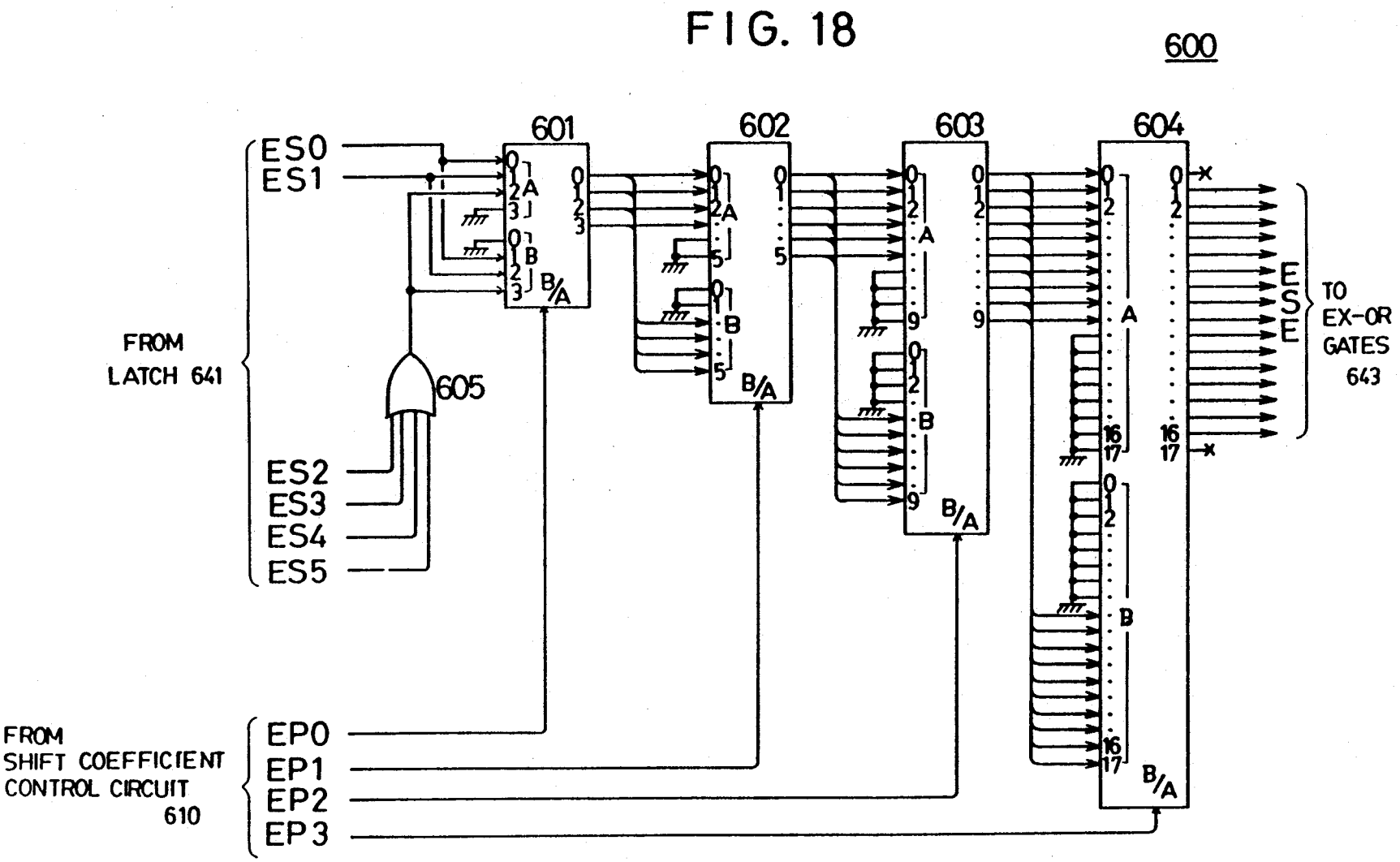
FIG. 18 is a circuit diagram showing the construction of an envelope speed data expanding circuit 600.

FIG. 18 is a circuit diagram showing the construction of the envelope speed data expanding circuit 600. The envelope speed data ESO is input to the "0" terminal of the group A and the "1" terminal of the group B of the selector 601; the data ES1 to the "1" terminal of the group A and the "2" terminal of the group B; an output of an OR gate 605 receiving the data ES2-5 to the "2" terminal of the group A and the "3" terminal of the group B; and data "0" to the "3" terminal of the group A and the "0" terminal of the group B, thereby, the bits ESO, I and another bit higher than the bit ES1 by 1 of the data ES shown in FIG. 22 are generated.

Further, 2-bit data "00", 4-bit data "0000" or 8-bit data "0000 . . . 0" is added to the four-bit data from the selector 601 through the selectors 602, 603 and 604 as higher order bits than the MSB of the four-bit data from the selector 601 or lower order bits than the LSB of the four-bit data from the selector 601. At that time, where the data is input to the group A of each of the selectors 601, 602, 603 and 604, the input data is not shifted to the left but is output without modification. Conversely, where the data is input to the group B of each of the selectors 601, 602, 603 and 604, the input data is shifted to the left in the selectors 601, 602, 603 and 604 by 1 bit, 2 bits, 4 bits and 8 bits, respectively. Accordingly, by appropriately selecting the input condition of each of the selectors 601, 602, 603 and 604 in accordance with the shift coefficient data EPO-3, the data ES can be shifted as shown in FIG. 23.

Therefore, although the compressed envelope speed data ES including the envelope add-subtract signal EDU is represented by using only 7 bits, the number of bits required to represent the data ES is increased to 16 bits by the expansion thereof, thereby reducing the memory area.

The data EA of 16 channels, which data is obtained by accumulating the thus expanded envelope speed data ESE, is latched by the group of the latches 650 with respect to each of the two musical sound components (A) and (B). Note, the value EA is represented by using 16 bits EAO-15. Further, 4 high order bits EA12-15 thereof represent the power part of the value EA; and 12 low order bits EAO-II thereof represent a mantissa part of the value EA.

8.2 Shift Coefficient Control Circuit 610

Figure 19:
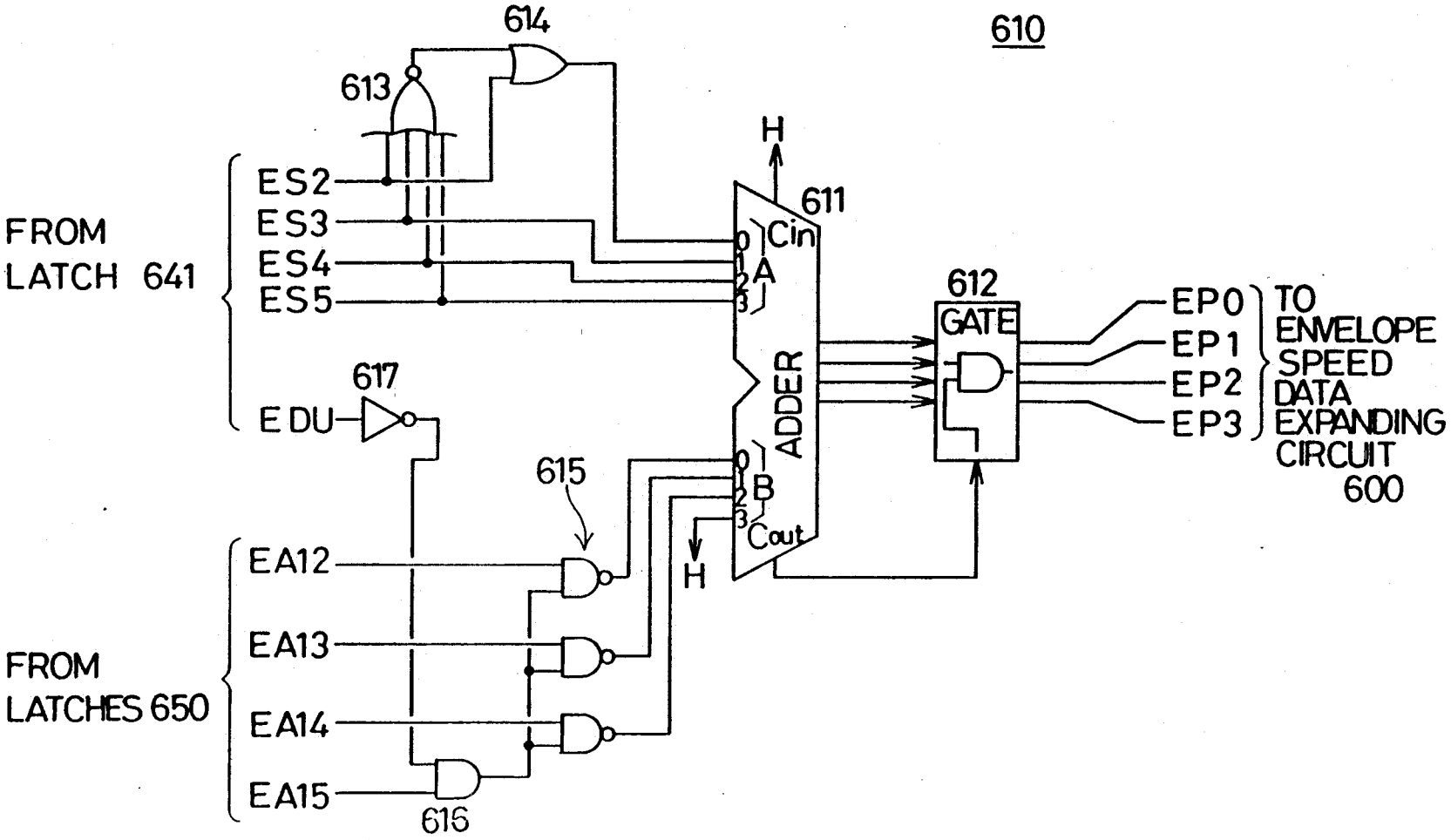
FIG. 19 is a circuit diagram showing the construction of a shift coefficient control circuit 610.

FIG. 19 is a circuit diagram showing the construction of the shift coefficient control circuit 610. Four high order bits of the compressed envelope speed data ES are input to the group A of the adder without modification and then output therefrom as the shift coefficient data EPO-3 through the group of AND gates 612, whereby the data shift as shown in FIG. 22, i.e., the expansion of the compressed envelope speed data ES, is effected. FIG. 22 illustrates the manner of the data shift when the input to the group B of the adder 611 does not affect the data shift. If an affect is felt, the manner of the data shift shown in this figure is modified. Note, when the envelope speed data ES2-5 is "0000", the shift coefficient data EP is set as "0001" by a NOR gate 613 and an OR gate 614, and thus as shown at the top of FIG. 23, even when the envelope speed data is "0000", the data shift position is the same as that where the envelope speed data is "0001".

The envelope add-subtract signal EDU for selecting the addition or the subtraction is inverted by the inverter 617 and is then supplied through an AND gate 616 to a group of NAND gates 615. Accordingly, a signal indicating "1111" is input to the group B of an adder 611 upon an attenuation in a period of time such as the decay or release time in which the signal EDU indicates "1". Further, a signal representing "1" is input at a Cin terminal of the adder 611, and as a result, the input data input at the group A of the adder 611 is not affected but output without modification. Furthermore, in the attack time in which the signal EDU indicates "0", data "1111" is input at the group B thereof and the input to the group A thereof is further output without modification when the MSB of the value EA is "0".

Conversely, when the MSB EA15 represents "1", the power data EA12-15 of the value EA is inverted and then fed to the group B of the adder 611 as a decrement.

Figure 25:
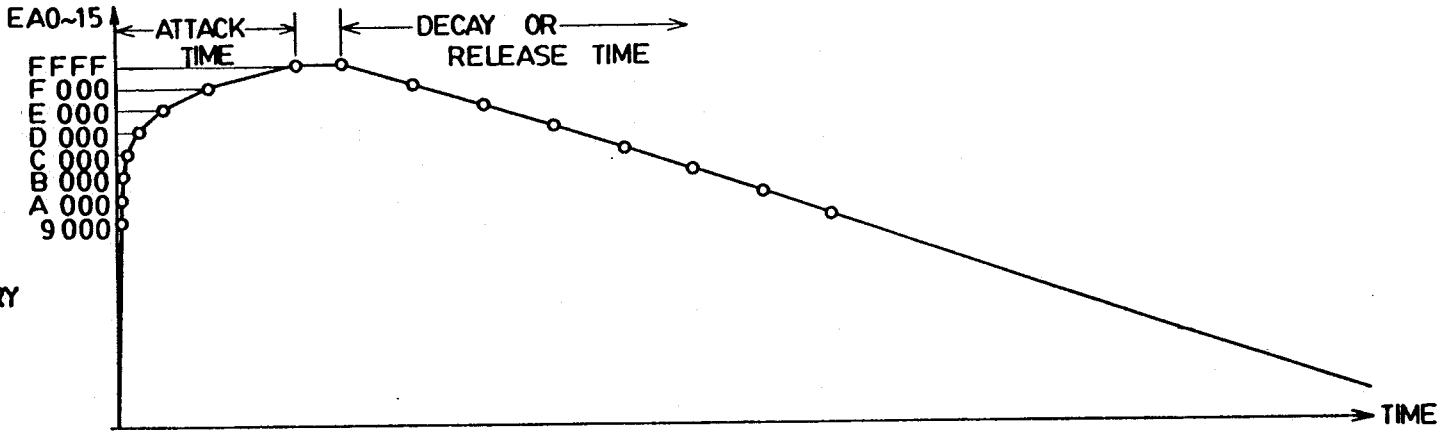
FIG. 25A, 25B is a waveform chart showing the envelope waveform in accordance with the value EA.
Figure 25:
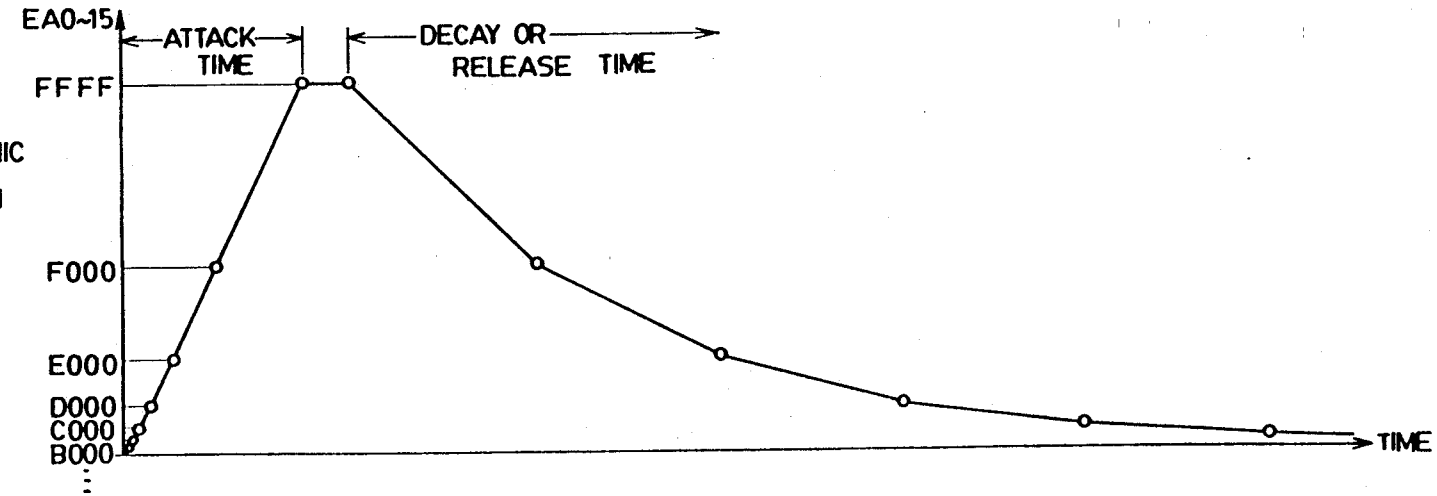

Accordingly, as the power data EA12-15 exceeds the value "1000" and further varies from "1001" ($=9_H$) to "1011" ($=B_H$) through "1010" ($=A_H$), the shift coefficient data EPO-3 is decreased from the original value in the following manner, $-1$, $-2$, $-3$, . . . Note, the subscript $_H$ is used to indicate a hexadecimal digit. Therefore, as shown in FIG. 2 3, the shifting-up (i.e. , left-shift) of the data in the envelope speed data expanding circuit 600 is restrained, and the value of the speed data ES gradually decreased in the following way, $\frac{1}{2}$, $\frac{1}{4}$, $\frac{1}{8}$ . . . As a result of this is that a portion of the envelope waveform corresponding to the attack time is shaped like an exponential curve as shown in FIG. 25 (A), and thus the powers of the attack portion of the envelope are closer to those of natural sounds. In this case, if the data EA12-15 is equal to or less than "1000" ($=8_H$), the waveform is not shaped like an exponential curve but has a linear shape. This is because, in such a range of the data EA12-15, there is substantially no difference between the resulting sound where the portion of the envelope corresponding to the attack time has an exponential waveform and that where such a portion has a linear waveform, i.e., in practice the difference there between cannot be discriminated by the human ear or the ability to perceive sounds. Thereby, the configuration of the circuits can be simplified.

Note, a signal from the Cout terminal of the adder 611 is supplied to the group of the AND gates 612 as an enable signal . Therefore, when the decrement supplied to the group B is increased in comparison with the data ES2-5, and a result the value of the shift coefficient data EPO-3 becomes negative, an output from the Cout terminal becomes equal to "0" and the group of AND gates 612 is disabled.

8.3 Phase Control Circuit 630

Figure 20:
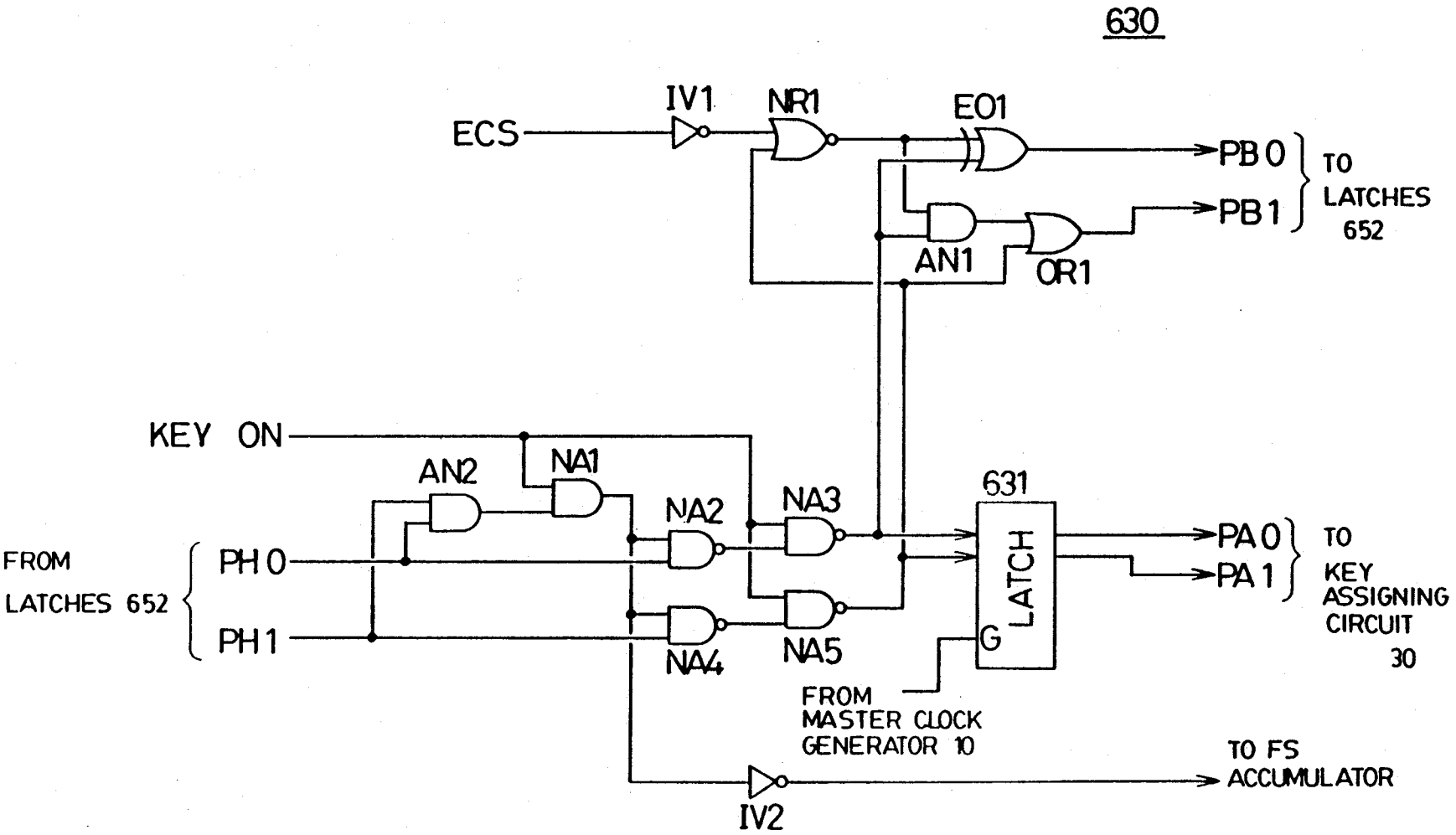
FIG. 20 is a circuit diagram showing the construction of a phase control circuit 630.

FIG. 20 is a circuit diagram showing the construction of the phase control circuit 630. Further, FIGS. 28 (A) and (B) are diagrams illustrating the data conversion effected by this phase control circuit 630. First phase parameters PHO,1 are obtained by the group of the latches 652 from preliminary phase parameters PBO,1 supplied thereto. This set of the first phase parameters PHO,1 represents the attack phase where the value thereof is "00" ($=O_H$), a second attack phase or the decay phase where the value thereof is "01" ($=1_H$), the sustain phase or a second decay phase where the value thereof is "10", ($=2_H$), and the release phase or a state in which there is no sound where the value thereof is "11" ($=3_H$).

Referring to FIG. 20, where the value represented by the "key on" signal is 110", an output of NAND gates NA3,5 becomes "11" regardless of the value of the first phase parameters PHO,1. Further, the value of a set of second phase parameters PAO,1 represented by an output of a latch 631 becomes "11" ($=3_H$) as shown in FIG. 28 (A). This is because the apparatus is forced into the release phase regardless of the current phase thereof if the apparatus enters a "key off" state (i.e., the key is turned off) during the radiation of the sound.

Further, where the "key on" signal indicates 11111 and an output of the NAND gate NA1 is "1", the first phase parameter PHO,1 is inverted by NAND gates NA2,4 having outputs which are further inverted by NAND gates NA3,5. Further, the outputs of the NAND gates NA3,5 are maintained as shown in FIG. 8 (A), because in such a case, only the current phase is maintained.

Furthermore, where the value indicated by the "key on" signal becomes "0" and that of the first phase parameters PHO,1 is "11" ($=3_H$) (i.e., in the released phase), the outputs of the NAND gates NA2,4 become "11". Therefore, outputs of the NAND gates NA3,5 become "00", and the value indicated by the second parameters PAO,1 becomes "00" ($=O_H$) as shown in the bottom of FIG. 28 (A). This is intended to change the value of the second parameters to "00" to bring the apparatus to the state of generating and radiating the next musical sound. At that time, an output of an inverter 1V2 becomes "0", and an on-event signal is output. Note, the latch 631 operates to latch a signal representing the first phase parameters in synchronization with the clock signal from the master clock generator 10.

Further, when the value indicated by the phase advancing signal ECS is "0", the data output from a NOR gate NR1 to an EX-OR gate E01 becomes "0". Also, the second phase parameter PAO is output therefrom without modification as the preliminary phase parameter PBO, and the AND gate AN1 is disabled so that the second phase parameter PA1 is output from an OR gate OR1 as the preliminary phase parameter PB1 having a value thereof maintained as shown in FIG. 28 (B). This is because it is necessary only to maintain the current phase if an advance of the phase is not instructed.

Conversely, when the phase advancing signal ECS indicates "1", the value indicated by the parameters PBO,1 becomes "01", and further, the phase is advanced to the next phase where that indicated by the parameters PAO,1 is "00", and where that indicated by the parameters PAO,1 is "01", that indicated by the parameters PBO,1 becomes "10" and the phase is also advanced to the next phase, as shown in FIG. 28 (B). This is because it is only necessary to advance the phase by one stage, i.e., to the next phase if an advance of the phase is instructed.

Where, however, the signal ECS indicates "1" and the value indicated by the parameters PAO,1 is "10" or "11", the phase is not advanced and the values of the parameters are maintained as shown in the bottom of FIG. 28 (B). This is because the phase is advanced in accordance with only the change of the "key on" signal, as will be explained hereinbelow. First, the transition of the phase from the second attack or decay phase (where the value indicated by the parameters PHO,1 is ($=2_H$)) to the release phase (where the value indicated by the parameters PHO,1 is "11" ($=3_H$)) occurs only when the state of the apparatus is changed from "key on" to "key off". Similarly, the transition of the phase from the release phase (where the value indicated by the parameters PHO,1 is "11" ($=3_H$)) to the next attack phase (where the value indicated by the parameters PHO,1 is "00" ($=O_H$)) occurs only when the state of the apparatus is changed from "key off" to "key on".

FIG. 27 is a diagram illustrating the manner in which the values of the phase parameters PHO,1 (or PBO,1) are stored in the group of latches 652. As shown in this figure, the values of the phase parameters of 16 channels CHO-15 are latched with respect to each of the musical sound components (A) and (B).

8.4 Thinning-out Circuit 620

Figure 21:
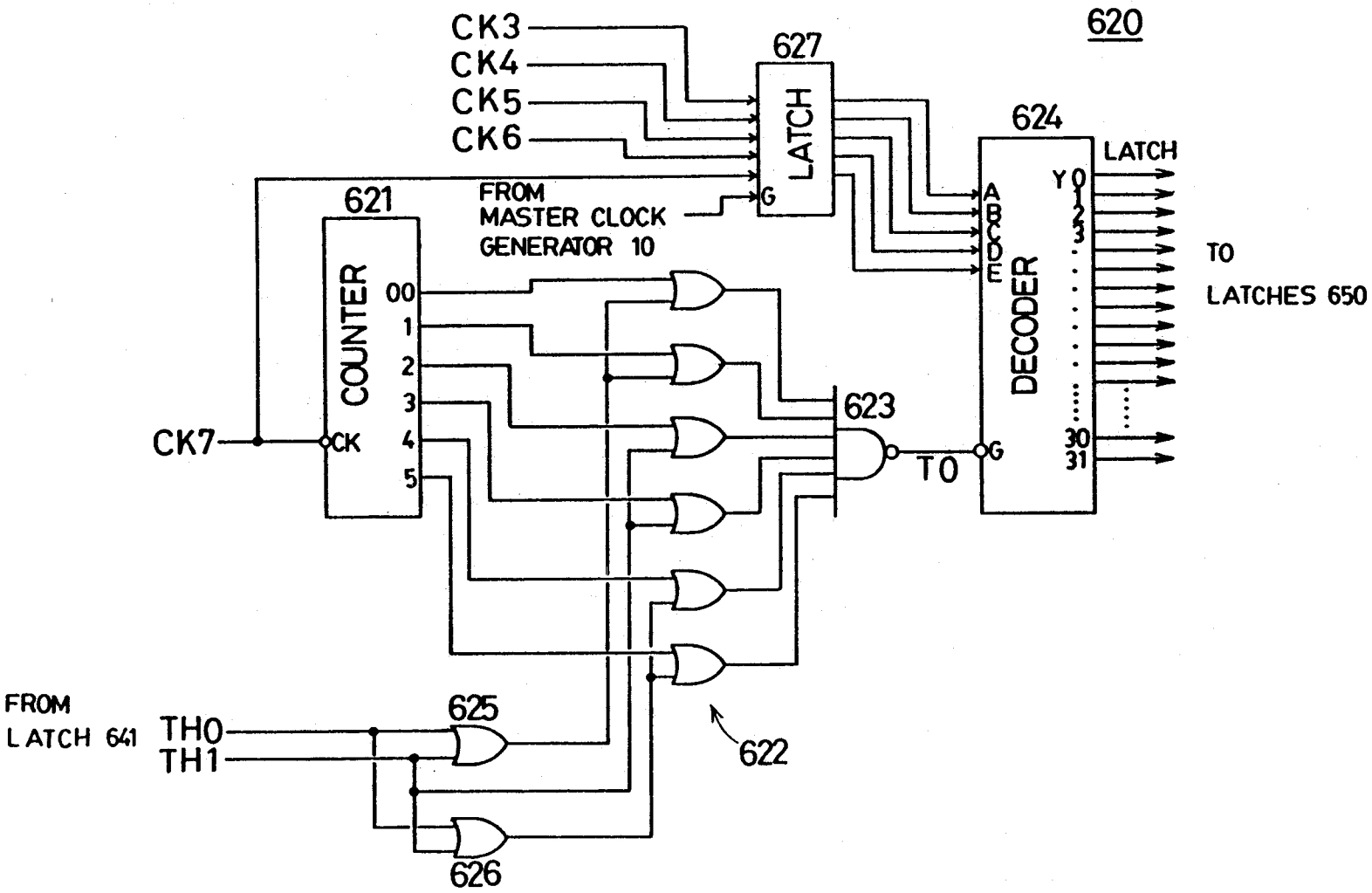
FIG. 21 is a circuit diagram showing -the construction of a thinning-out circuit 620.
Figure 29:
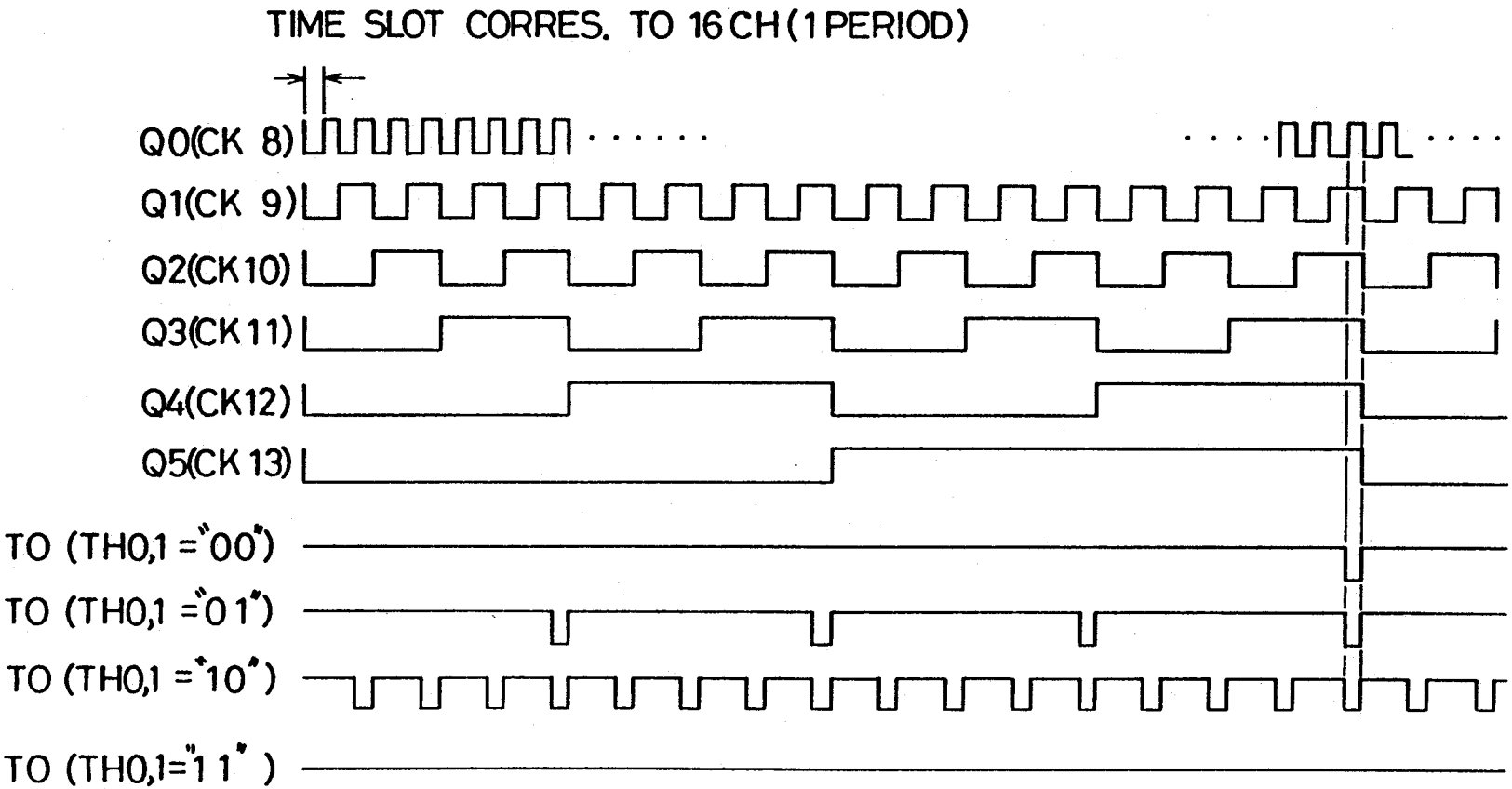
FIG. 29 is a timing chart for illustrating an operation of the thinning-out circuit 620.

FIG. 21 is a circuit diagram showing the construction of the thinning-out circuit 620. In this figure, a counter 621 receives the clock signal CK7 and outputs clock signals $Q_0, Q_1, \ldots Q_5$ having periods respectively two times, four times, . . . and thirty-two times that of the clock signal CK7. These clock signals $Q_0, Q_1, \ldots Q_5$ are output from a NAND gate 623 through a group of OR gates 622 as a latch signal TO. The thinning-out data THO,1 represented by a signal sent from the assignment storing memory 32 and indicating the above described thinning-out rate, is supplied to the group of OR gates 622 through an AND gate 625 and an OR gate 626. Further, the data TH1 is also supplied to a part of the group of the OR gates 622 without change. Therefore, outputs of the OR gates each supplied with a signal indicating "1" are continuously forced to be "1", and each of the clock signals $Q_0, Q_1, \ldots Q_5$ is made invalid.

Where the value indicated by the data THO,1 is "00", all of the clock signals $Q_0, Q_1, \ldots Q_5$ become valid, and thus the latch signal TO indicates "0" only when each of the clock signals $Q_0, Q_1, \ldots Q_5$ indicates "1". In this case, as shown in a lower part of FIG. 29, the rate of output of the latch signal is one time per 64 times of receiving the clock signal CK7, which is received at an original latching rate.

Further, where the data THO,1 indicates the value "01", only the clock signals $Q_{0\text{-}3}$ are valid so that the latch signal TO indicates "0" only when the signals $Q_{0\text{-}3}$ indicate "1". Thus, as shown in the lower part of FIG. 29, the rate of output of the latch signal is one time per 16 times of receiving the clock signal CK7, which is received at the original latching rate.

Moreover, where the data THO,1 indicate the value "10", only the clock signals $Q_{0,1}$ are valid so that the latch signal TO indicates "0" only when the signals $Q_{0,1}$ indicate "1". Thus, as shown in the lower part of FIG. 29, the rate of output of the latch signal is one time per 4 times of receiving the clock signal CK7, which is received at the original latching rate.

Furthermore, where the data THO,1 indicate the value "11", all of the clock signals $Q_{0\text{-}5}$ are invalid so that the latch signal TO continuously indicates "0" regardless of the clock signals $Q_{0\text{-}5}$. Accordingly, as shown in the lower part of FIG. 29, the rate of output of the latch signal is the same as the rate of receiving the clock signal CK7, i.e., the original latching rate.

The thus-generated latch signal TO is output from one of 32 output lines of a decoder 624, and the thinning of the value EA is effected in a corresponding one of the latches 650. This thinning-out operation is serially effected at each of the latches 650. Further, the selection of one of the 32 output lines is carried out by using the clock signals CK3-7.

Figure 30B:
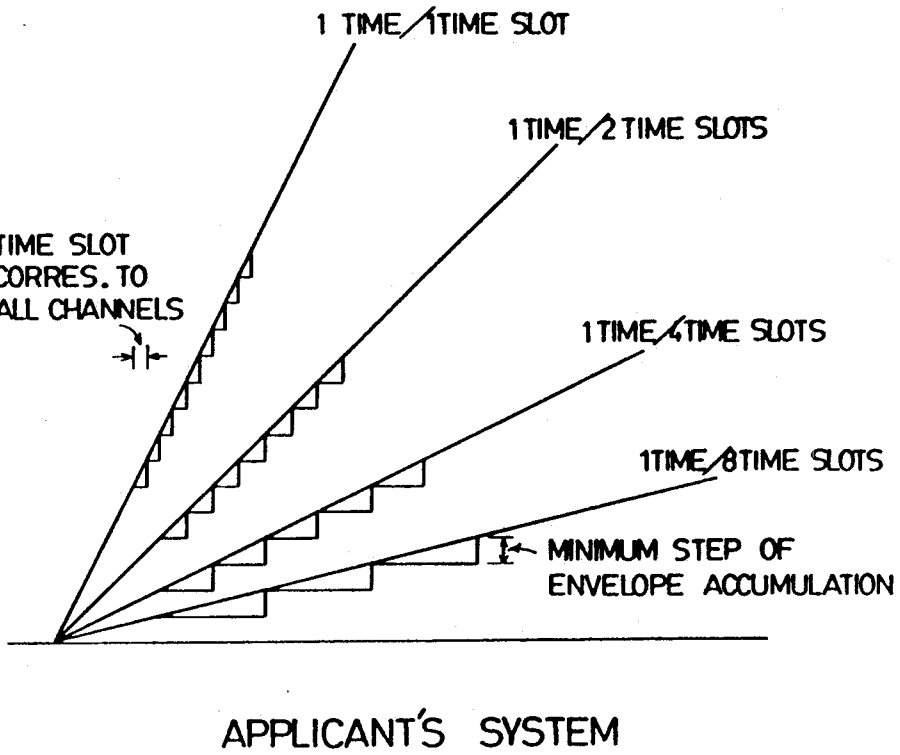
FIG. 30A, 30B is a diagram for illustrating the effects of the thinning-out of the performance of latching operations.
Figure 30A:
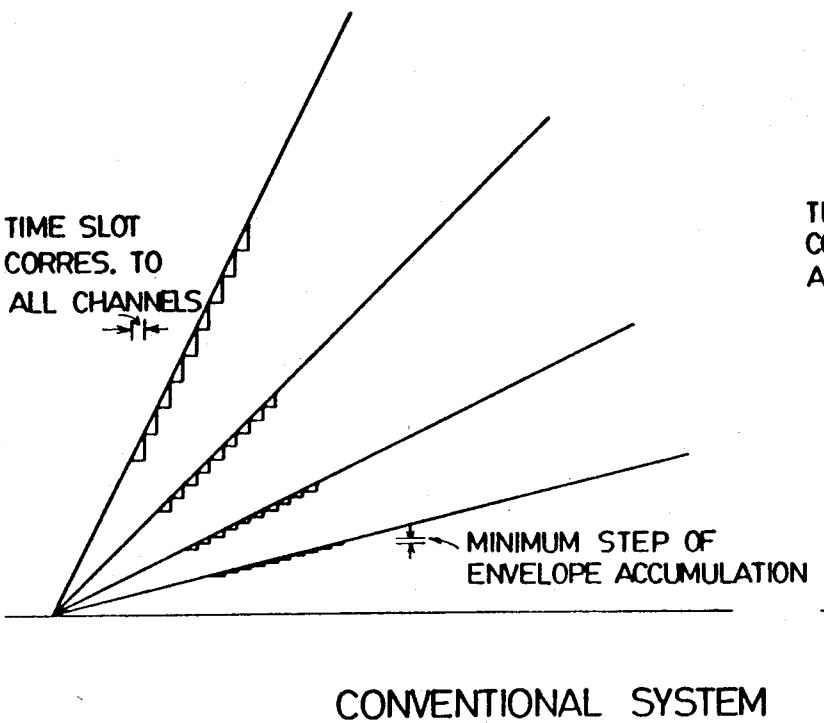

Therefore, as shown in FIG. 30, by thinning out the performance of latching the values EA, the apparatus of the present invention can radiate a musical sound having a good operability.

Note, the latch 627 operates in synchronization with the clock signals sent from the master clock generator 10.

9. Multiplying Circuit 70

Figure 31:
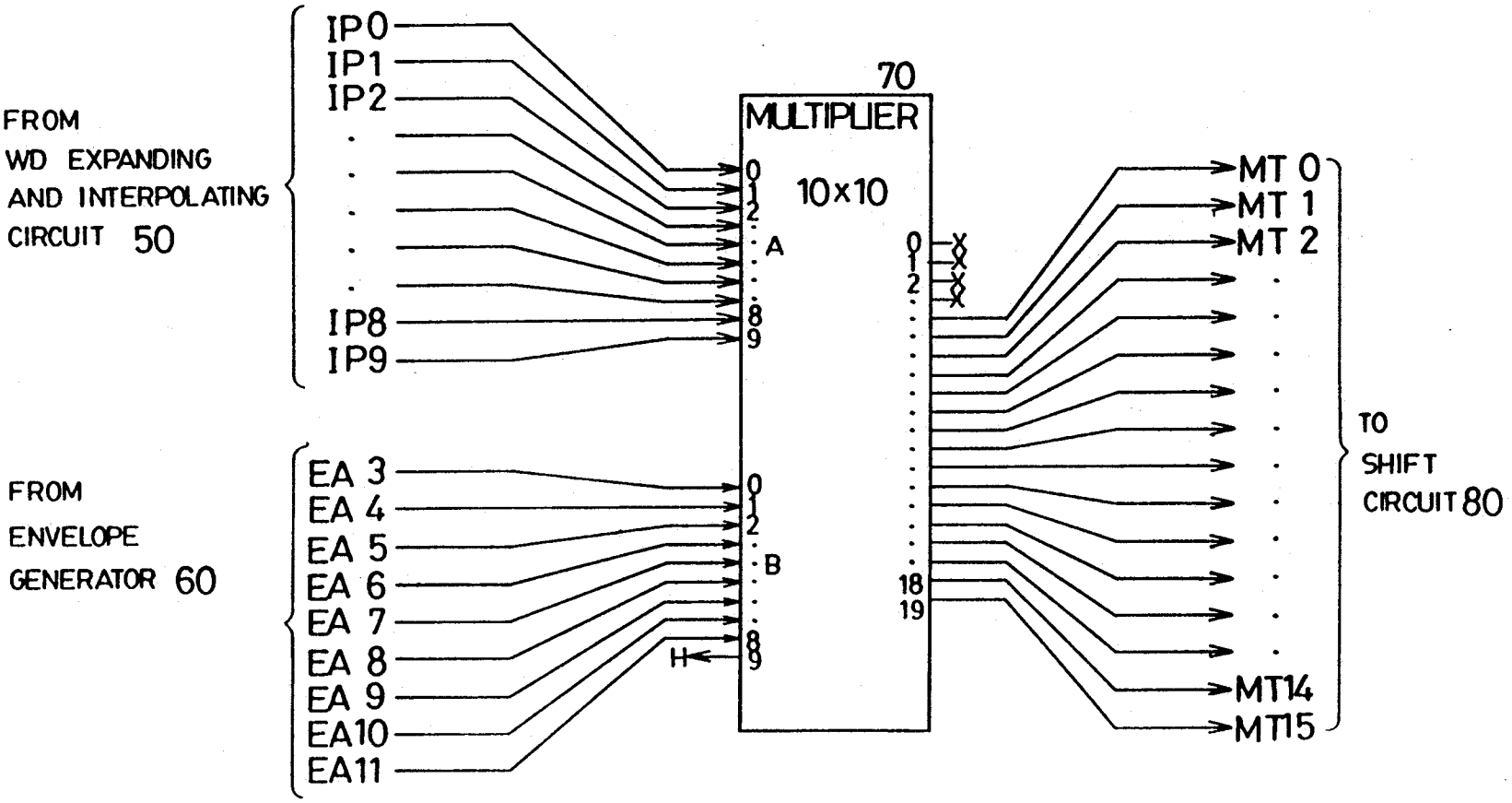
FIG. 31 is a diagram showing the construction of a multiplying circuit 70.

FIG. 31 is a circuit diagram showing the construction of the multiplying circuit (hereinafter referred to simply as the multiplier) 70. As shown in this figure, the interpolated waveform data IPO-9 composed of the sampled values of the waveform data RD and the interpolated values thereof sent from the WD expanding and interpolating circuit 50 is supplied to the multiplier 70. Further, the envelope mantissa data EA3-11 obtained by removing parts corresponding to 4 high order bits and 3 low order bits from the value EAO-15 fed from the envelope generator 60 is also supplied to the multiplier 70, whereupon the waveform data is multiplied by the envelope mantissa data.

At that time, the value "1" is added to the envelope mantissa data EA3-11 as data having a higher order than the MSB of the data EA3-11. This addition of data "1" to the mantissa data EA3-11 is equivalent to an operation given by the following equation ($1+M/2^9$) where M denotes 9-bit data represented by the bits EA3-11 of the mantissa part of the value EA. Further, the resulting data of this operation is multiplied by the interpolated waveform data IP. The result of this multiplication is output from the multiplier 70 as data represented by using 20 bits, but as shown in this figure, 4 low order bits of this 20-bit data are truncated, and thus the data represented by using the remaining 16 bits (hereinafter referred to as the multiplication data) MTO-15 is output to the shift circuit 80.

10. Shift Circuit 80

Figure 32:
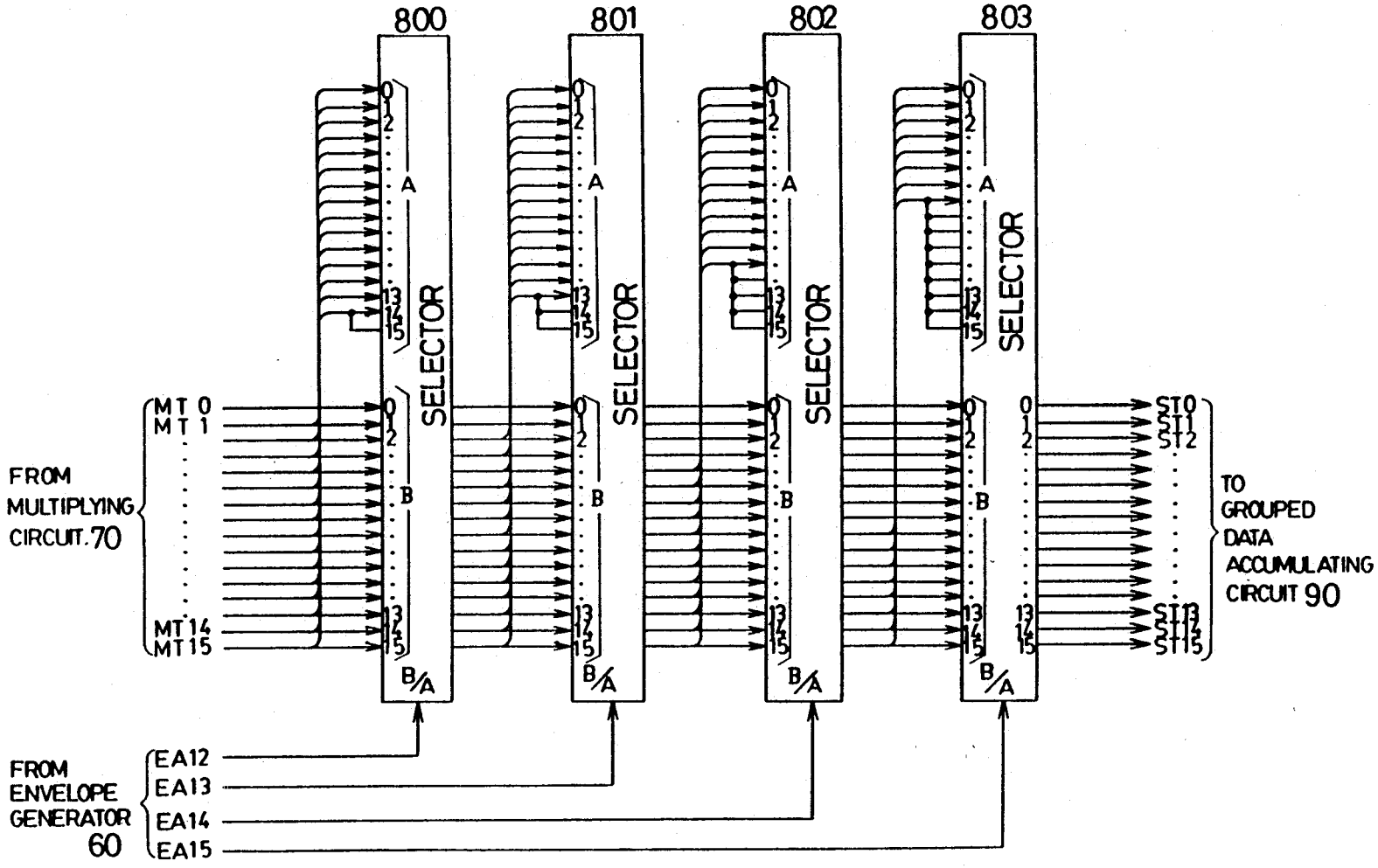
FIG. 32 is a circuit diagram showing the construction of a shift circuit 80.

FIG. 32 is a circuit diagram showing the construction of the shift circuit. The multiplication data MTO-15 are shifted to the right by four selectors 800, 801, 802, and 803, corresponding to the envelope power data EA1-2-15, and the result is output to the grouped data accumulating circuit 90 as the musical sound data STO-15.

The selector 800 shifts the multiplication data MT to the right by 1 bit when the selection signal EA12 indicates "0". Conversely, when the selection signal EA12 indicates "1", the selector 800 does not shift the data MT but outputs this data to the selector 801 without modification. Next, the selector 801 shifts the data MT to the right by two bits when the signal EA13 indicates "0". When the signal EA13 indicates "1", the selector 801 outputs the data MT without modification to the selector 802. Then the selector 802 shifts the data MT to the right by four bits when the value indicated by the signal EA14 is "0". Conversely, when the signal EA14 indicates 111, the selector 802 outputs the unchanged data MT to the selector 803, and thereafter, the selector 803 shifts the data MT to the right by eight bits when the signal EA15 indicates "0", and outputs the unchanged data MT to the grouped data accumulating circuit 90 when "1" is indicated.

Accordingly, the smaller the value indicated by the envelope power data, the larger the total number of bits shifted to the right. Further, assuming P denotes the value represented by the envelope power data EA1-2-15, then as is understood from the foregoing description, the value $2^{P-16}$ is calculated in this shift circuit 80. Thus, assuming R denotes the interpolated waveform data, an output of this shift circuit 80 becomes $2^{P-16}\times(1+M/2^9)\times R$. In this case, the "1" in parentheses can be omitted, and if this "1" is omitted, the input to the "9" terminal of the group B of the multiplying circuit 70 is set as "0".

Figure 33:
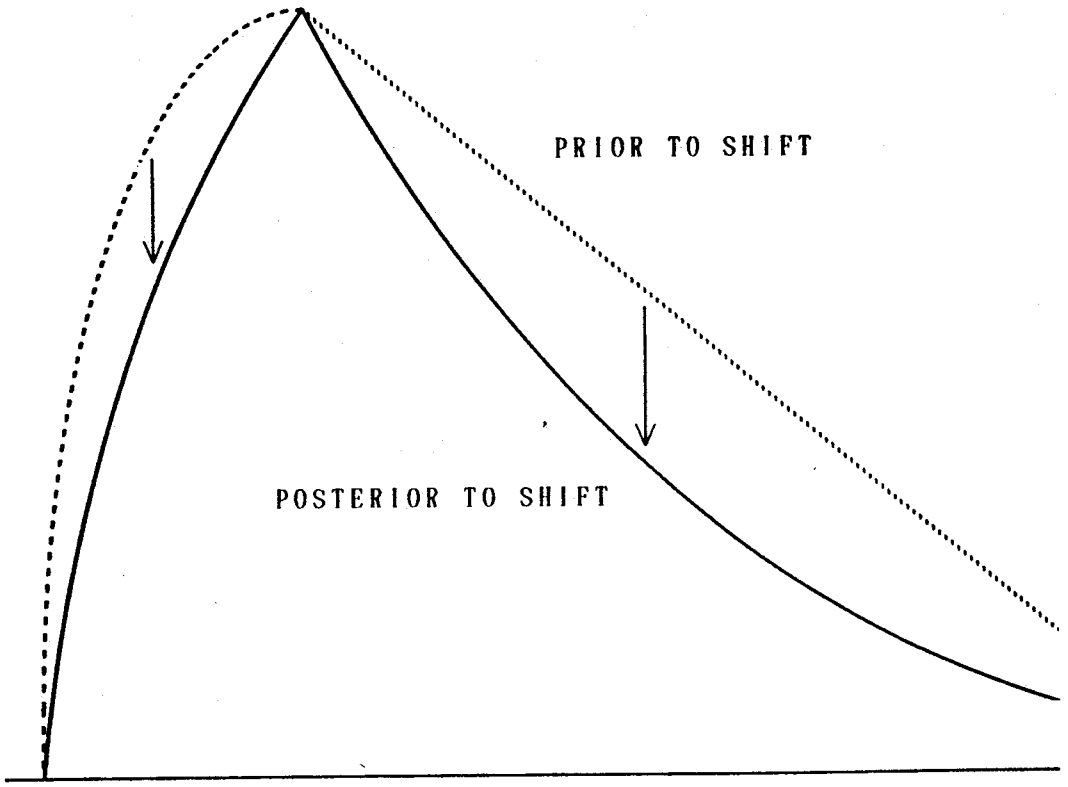
FIG. 33 is a diagram for illustrating the modification of the envelope waveform by a shift circuit 80.

Further, the lower the level of the envelope, the larger the proportion of the reduction due to the right-shifting to the level of the envelope, and thus, by shifting the data MT to the right as described above, the attenuating portion of the envelope waveform corresponding to the decay phase or the release phase is shaped like an exponential curve as shown in FIG. 33, in which the portion of the envelope waveform obtained prior to the shift is shown by a one-dot chain line and the portion of the envelope waveform obtained after the shift is shown by a solid line. Thereby, the sound radiated by the apparatus of the present invention can be closer to the natural sound.

11. Grouped Data Accumulating Circuit 90

Figure 34:
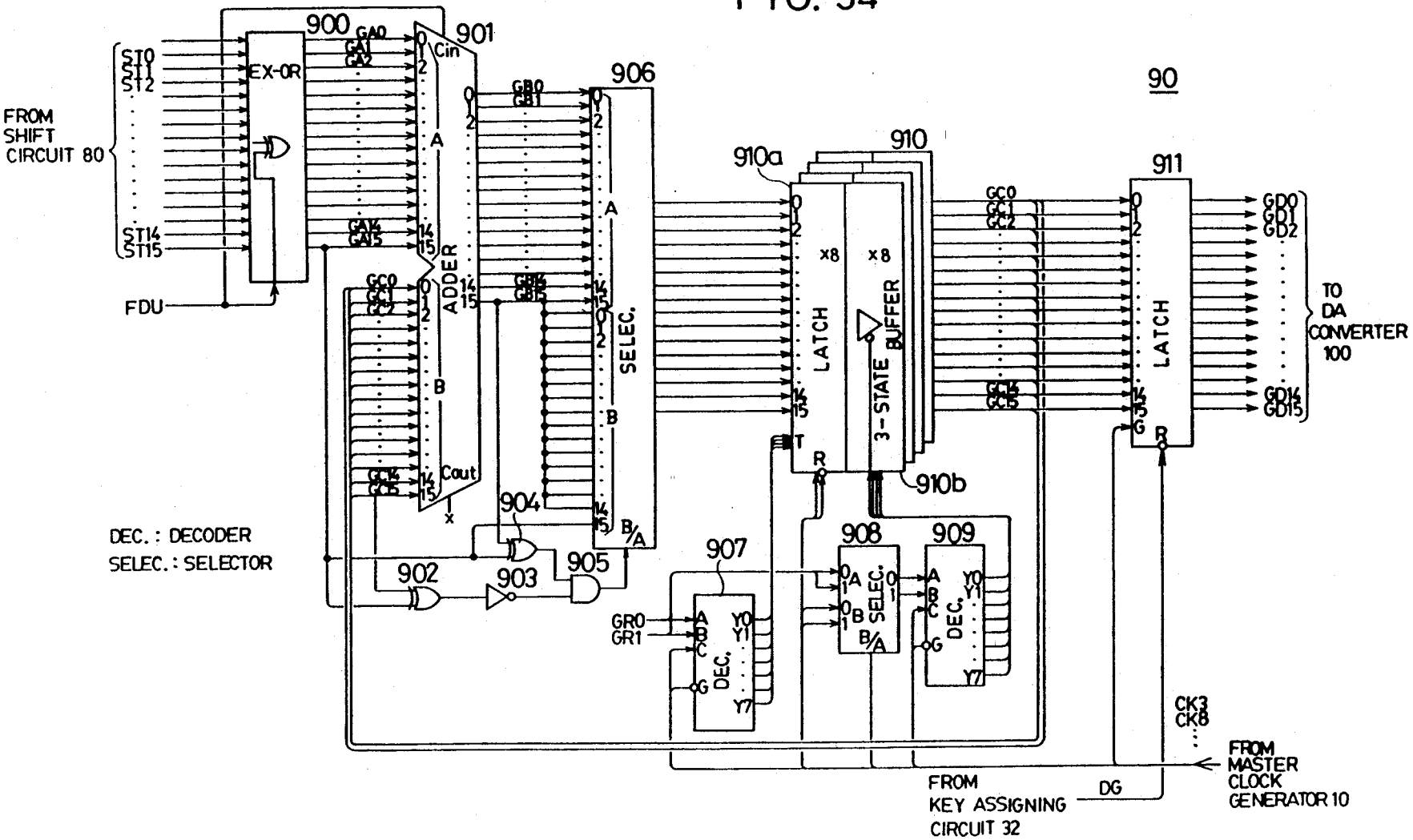
FIG. 34 is a circuit diagram showing the construction of a grouped data accumulating circuit 90.

FIG. 34 is a circuit diagram showing the construction of the grouped data accumulating circuit 90. The sign of the sound data STO-15 from the shift circuit 80 is changed by a group of EX-OR gates 900 when the value represented by the waveform folding signal FDU, which is used to indicate that the waveform data is negative, is The changed or inverted sound data GAO-15 is accumulated by an adder 901 to the current value of the accumulated sound data GCO-15 of each group, and the signals representing the result of the accumulation are supplied to the group A of a selector 906. The waveform folding signal FDU is fed to a Cin terminal of the adder 901, and when the waveform data is negative, the waveform data is corrected by being increased by 1.

Moreover, 15-bit data, each bit of which indicates the value indicated by the MSB GC15 of the data GC, is supplied to the group B of the selector 906. Furthermore, the MSB GA15 of the data GA, which has a value at a stage prior to the accumulation by the adder 901, is also fed to the group B of the selector 906 as the MSB of the bit-group B, when an overflow occurs, the maximum (positive) value "011 . . . 1" is input to the group B of the selector 906, and, conversely when an underflow occurs, the maximum (negative) value, the absolute value of which is "1000 . . . 0", is input to the group B thereof, and further the input value is output as new accumulated sound data GC from the selector 906. Note, the MSB of the input value "011 . . . 1" or "1000 . . . 0" represents the sign thereof.

This overflow or underflow is detected as follows. Namely, the MSB GA15 of the sound data GA and the MSB GC15 of the current accumulated sound data GC are output from an inverter 903 through an EX-OR gate 902. Where the data indicated by the bit GA15 matches that indicated by the bit GC15, if the value indicated by the bit GA15 is "00", it is judged that the addition has been performed. Conversely, if the value indicated by the bit GA15 is "11", it is judged that the subtraction has been performed. As a consequence, an AND gate 905 is disabled.

Next, the MSB GB15 of the accumulated sound data GB output by the adder 901 and the MSB GA15 of the data GA are input to an EX-OR gate 904. When it is detected that the data represented by the MSB GB15 and that represented by the MSB GA15 do not match, i.e, that the former data has become "1" during the addition and an overflow has occurred or that the former data has become "0" during the subtraction and an underflow has occurred, a detection signal is supplied through an AND gate 905 to the selector 906 as a selection signal. Further, as described above, the maximum (positive) value "011 . . . 1" is input to the group B where an overflow occurs, or the maximum (negative) value "100 . . . 0" is input to the group B.

Accordingly, even when the accumulated value GB of the sound data overflows or underflows, the level of the amplitude of a sound signal can be maintained at the maximum level thereof. Therefore, a special decision bit can be omitted, and the quantity of data to be processed can be substantially decreased.

The data GCO-15 are input to four latch buffers 910. Each latch buffer 910 is composed of eight latches 910a and eight 3-state buffers 910b having substantially the same functions as a selector has. These eight latches are divided into two groups to be alternately switched from one to the other, i.e. , a group (a) used for accumulating the musical sound data and a group (b) used for outputting the accumulated value, each of which is composed of four latches. Further, each of the four latch buffers 910 corresponds to a different one of four groups or kinds of musical sounds formed by the DA converter 100 and the sound radiating system 110. The musical sound data of each group is generated and accumulated separately.

Further, sixteen channels CHO-15 are divided into four groups each corresponding to a different one of the four groups of the musical sound data. Namely, musical sound (A) (B) of channels CHO-3 are assigned to a first group of the musical sound data; musical sound (A) (B) of channels CH4-7 to a second group of the musical sound data; musical sound (A) (B) of channels CH8-11 to a third group of the musical sound data; and musical sound (A) (B) of channels CH12-15 to a fourth group of the musical data.

Figure 35:
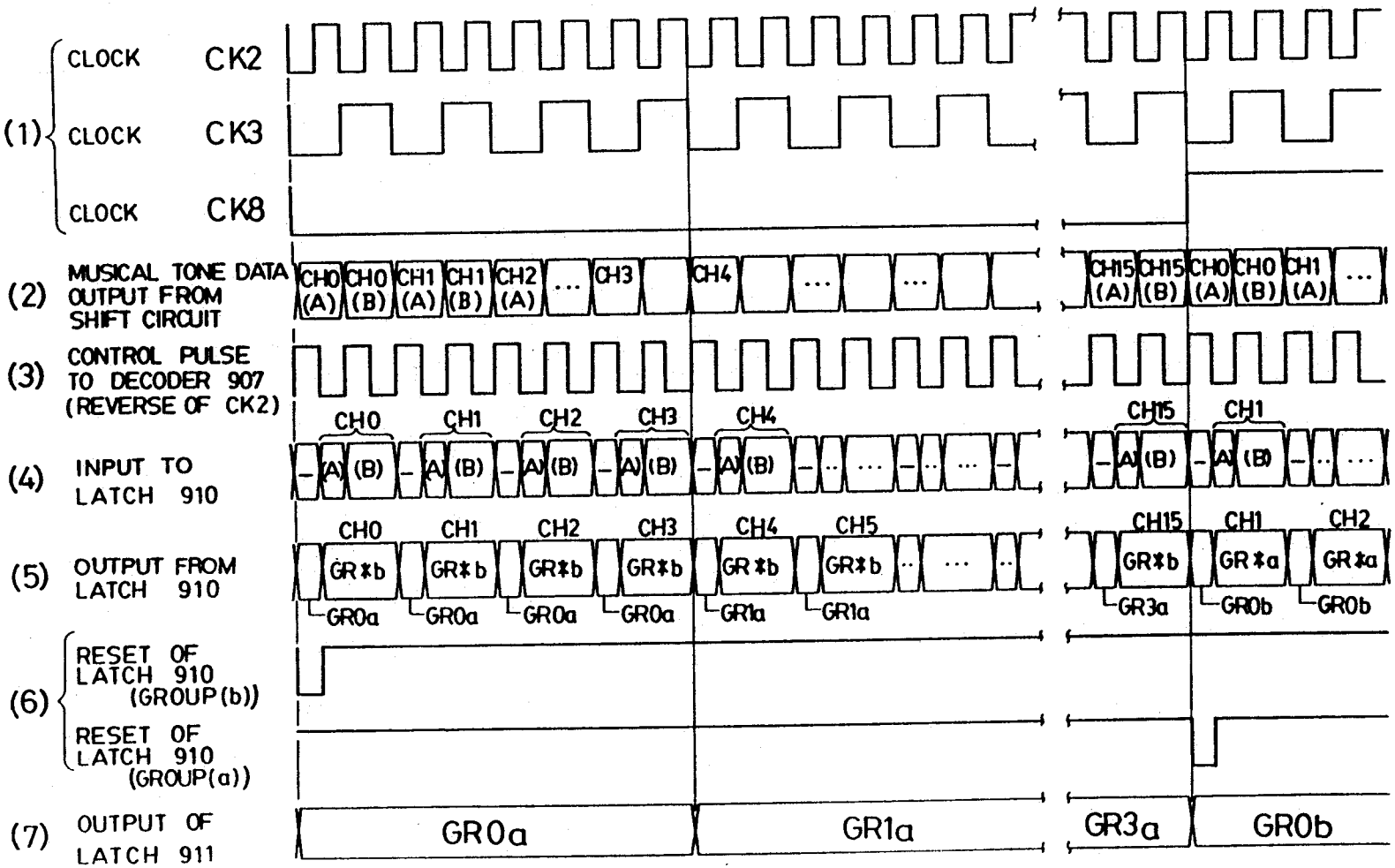
FIG. 35 is a timing chart for illustrating the operation of grouped data accumulating circuit 90 of FIG. 34.

The group of the musical sound data is indicated by a group data GRO,1 from the assignment storing memory 32. A decoder 907 fetches the group data GRO,1 and the clock signal CK8, every time the clock signal CK3 shown in FIG. 35 (1) and the inverted signal of clock signal CK2 shown in FIG. 35 (3) is received, and decodes them to sequentially select a latch to which the accumulated value in one of the latch buffer 910 is written. FIG. 35 (4) is a timing chart illustrating how such a processing is performed every time the clock signal CK3 and the inverted signal of clock signal CK2 input to the decoder 907 rises. This every time is as shown in FIG. 35 (4) every time of (A) (B) in channels CH0, CH2, CH3 ... CH15. As shown in FIG. 35 (7) the musical sound data (A) (B) of each group of each four channels, which are outputted from shift circuit 80, are generated and accumulated separately. In the FIG. 35, the symbol * indicates the number of the group of musical sounds corresponding to the channel indicated directly over the character GR*a or GR*b and takes a value 0, 1, 2 or 3. In addition, a character a (or b) positioned immediately after the character * represents the group a (or b) of the latches 910a corresponding to the musical sound component (A) (or (B)).

The group data GRO,1 is also supplied through a selector 908 to a decoder 909. Further, this decoder 909 also fetches the group data GRO,1 and the clock signal CK8, every time the clock signal CK3 and the clock signal CK2 or the inverted signal of clock signal CK2 is received, and decodes them and controls the 3-state buffer to sequentially select a latch for reading the current accumulated value in one of the latch buffers 910. As shown in FIG. 35 (5), such a processing is performed in time slots indicated by only the group number GR0b, GR1b, GR2b . . . Conversely, another clock signals are supplied together with the clock signals and the clock signal CK8 to the decoder 909 every time the clock signal CK2 rises, the decoder 909 then decodes them and controls the 3-state buffer 910b, and sequentially selects a latch for reading the accumulated value stored in the latch buffer 910. This processing is effected in time slots indicated by sets of the channel number CH0, CH1, ... and the corresponding group number GROA, GRIA, GR2a .... and thus, as shown in FIG. 35 (4) (5), the accumulation is performed in a latch only where the time of writing the accumulated value thereto is in accordance with that of reading the accumulated value therefrom. The reading of the accumulated musical sound data is effected in latches other than such a latch.

Further, the musical sound data GC from the latch buffer 910 is output through a latch 911 to the DA converter 100. Referring to FIG. 35 (5), the latching of the data GC is effected by the latch 911 in time slots indicated by using only the group numbers GROA, GR1a, GR2a . . . As shown in FIG. 35 (7), the data GS of each group is output by alternately using -the latches of the group (a) and those of the group (b). Note, a pulse shown in FIG. 35 (6) is supplied from the master clock generator 10 to the latch buffers 10, whereby the latches of the group (a) and those of the group (b) are alternately reset. Furthermore, the latch 911 is reset by a DA gate signal from the key assigning circuit 30.

Although a preferred embodiment of the present invention has been described above, it should be understood that the present invention is not limited thereto and that other modifications will be apparent to those skilled in the art without departing from the spirit of the invention. For example, the combination of the two musical tones (A) and (B) need not be selected by the timbre switches 2 but can be selected from 128 timbres by using ten-keys. Further, the touch data TO may be data corresponding to a key pressing speed data representing the speed of pressing a key. In this case, a period from a time of the turning-on a break contact to the time of turning-on a make contact can be used as the touch data TO. Furthermore, a multiplier to which a parameter signal varying with time is applied as multiplication data may be provided at an output terminal of the waveform data expanding and interpolating circuit 50. Accordingly, the weight or influence of the musical tone (A) and that of the musical tone (B) may be changed while a musical sound is emitted, and further, the combination of musical tones may be modified according to the length of the musical tones. In such a case, parameter signals, each of which corresponds to one of 16 channels and which are applied during a first half of one cycle of the clock signal CK3, are different from the parameter signals, each of which also corresponds to one of 16 channels, and which are applied during a second half of one cycle of the clock signal CK3.

As described above in detail, in accordance with the present invention, there is provided a musical tone waveform generating device in which, in response to an instruction for emitting a musical sound, any combination of selected waveform data can be read from a storage, and accumulated and synthesized in a reading step of a precessing program common to the musical tones, by effecting a time sharing processing. Alternatively, in accordance with the present invention, there is provided a musical tone waveform generating device in which, in response to an instruction for emitting a musical sound, selected waveform data are read out in a reading step of a processing program common to the musical tones, are separately controlled by using envelopes, and are accumulated and synthesized, whereby more than two waveform data selected and read out in response to an instruction for emitting a musical sound can be combined with each other. Further, where the waveform data to be combined with each other are separately controlled by using the envelopes, the musical tones to be emitted can be changed during a period of a time from the initiation thereof to the time of a termination thereof, and thus the device can variegate the generated musical sound.

I claim:

1. A device for generating a waveform of a combined musical tone, comprising:

single waveform data and musical program storing means for storing waveform data of a plurality of musical tones and for storing a musical processing program for processing musical data to generate and radiate musical sounds;

sound emission instructing means, including a plurality of sound emission instructors, for issuing instructions for emitting musical tones;

assignment storing means, for storing musical tone data for at least two musical tones of said plurality of musical tones of waveform data stored in said single waveform data and musical program storing means in response to a single instruction issued by said sound emission instructing means, according to the musical processing program stored in said single waveform data and musical program storing means;

musical tone channel means, including a plurality of musical tone channels of a number less than a number of said plurality of sound emission instructors and equal to a maximum number of musical tones which can be sounded simultaneously;

channel assigning means for assigning said at least two musical tones to said musical tone channel means according to the musical tone data stored in said assignment storing means;

waveform data reading means for reading out waveform data of said at least two musical tones assigned to said musical tone channel means by said channel assigning means, from said single waveform data and musical program storing means, utilizing a time share process, said waveform data reading means being included in a tone generated means; and synthesizing means for accumulating and synthesizing the waveform data of said at least two musical tones read out by said waveform data reading means utilizing a time share process in order to generate the waveform of the combined musical tone, such that storage addresses of said waveform data and said musical processing program in said single waveform data and musical program storing means are accessed at respective different times.

2. A device for generating a waveform of a combined musical tone, comprising:

single waveform data and musical program storing means for storing waveform data of a plurality of musical tones and for storing a musical processing program for processing musical data to generate and radiate musical sounds;

musical tone selecting means for selecting at least two musical tones of said plurality of musical tones of waveform data stored in said single waveform data and musical program storing means;

sound emission instructing means, including a plurality of sound emission instructors, for issuing instructions for emitting musical tones;

musical tone channel means, including a plurality of musical tone channels of a number less than a number of said plurality of sound emission instructors and equal to a maximum number of musical tones which can be sounded simultaneously;

channel assigning means for assigning said at least two musical tones selected by said musical tone selecting means to said musical tone channel means in response to a single instruction issued by said sound emission instructing means, according to the musical processing program stored in said single waveform data and musical program storing means;

waveform data reading means for reading out waveform data of said at least two musical tones assigned to said musical tone channel means by said channel assigning means, from said single waveform data and musical program storing means, utilizing a time share process, said waveform data reading means included in a tone generating means; and synthesizing means for accumulating and synthesizing the waveform data of said at least two musical tones read out by said waveform data reading means utilizing a time share process in order to generate the waveform of the combined musical tone, such that storage addresses of said waveform data and said musical processing program in said single waveform data and musical program storing means are accessed at respective different times.

3. A device for generating a waveform of a combined musical tone, comprising:

single waveform data and musical program storing means for storing waveform data of a plurality of musical tones and for storing a musical tone processing program for processing musical data to generate and radiate musical sounds;

sound emission instructions means, including a plurality of sound emission instructors, for issuing instructions for emitting musical tones;

musical tone channel means, including a plurality of musical tone channels, of a number less than a number of said sound emission instructors and equal to a maximum number of musical tones which can be sounded simultaneously;

channel assigning means for assigning at least two musical tones of said plurality of musical tones to said musical tone channel means in response to a single instruction issued by said sound emission instructing means, according to the musical processing program stored in said single waveform data and musical program storing means, said waveform data reading means included in a tone generating means;

waveform data reading means for reading out waveform data of said at least two musical tones assigned to said musical tone channel means, by said channel assigning means from said single waveform and musical program data storing means, utilizing a time share process;

envelope generation means for generating envelope waveform data;

envelope control means for separately envelope-controlling, utilizing a time share process, the waveform data for each of said at least two musical tones read out by said waveform data reading means utilizing a time share process, according to envelope waveform data generated by envelope generation means; and synthesizing means for accumulating and synthesizing the waveform data of said at least tow musical tones envelope-controlled by said envelope control means utilizing a time share process in order to generate the waveform of the combined musical tone, such that storage addresses of said waveform data and said musical processing program in said single waveform data and musical program storing means are accessed at respective different times.

4.

A device for generating a waveform of a combined musical tone, comprising:

single waveform data and musical program storing means for storing waveform data of a plurality of musical tones and for storing a musical processing program for processing musical data to generate and radiate musical sounds;

musical tone selecting means for selecting at least two musical tones of said plurality of musical tones of waveform data stored in said single waveform data nd musical program storing means;

sound emission instructing means, including a plurality of sound emission instructors, for issuing instructions for emitting musical tones;

musical tone channel means, including a plurality of musical tone channels of a number less than a number of said sound emission instructors and equal to a maximum number of musical tones which can be sounded simultaneously;

channel assigning means for assigning the at least two musical tones selected by said musical tone selecting means to said musical tone channel means in response to a single instruction issued by said sound emission instructing means, according to the musical processing program stored in said single waveform data and musical program storing means;

waveform data reading means for reading out waveform data of said at least two musical tones assigned to said musical tone channel means by said channel assigning means, from said single waveform data and musical program storing means, utilizing a time share process, said waveform data reading means included in a tone generating means;

envelope generation means for generating envelope waveform data; envelope control means for separately envelope-controlling, utilizing a time share process, each of the waveform data of said at least two musical tones read out by said waveform data reading means utilizing a time share process, according to envelope waveform data generated by envelope generation means; and synthesizing means for accumulating and synthesizing the waveform data of said at least two musical tones envelope-controlled by said envelope control means utilizing a time share process, in order to generate the waveform of the combined musical tone, such that storage addresses of said waveform data and said musical processing program in said single waveform data and musical program storing means are accessed at respective different times.

5. The device for generating a waveform of a combined musical tone of claim 2 or 4, wherein said musical tone selecting means outputs upper address data to said single waveform data and musical program storing means, and said waveform data reading means outputs lower address data to said single waveform data and musical program storing means.

6. The device for generating a waveform of a combined musical tone of claim 1, 2, 3 or 4, wherein the synthesized data is changed according to the musical tone to be used for emitting the musical sound.

7. The device for generating a waveform of a combined musical tone of claim 1, 2, 3 or 4, wherein the synthesized waveform data is changed according to the tone pitch to be used for emitting the musical sound.

8. The device for generating a waveform of a combined musical tone forth in claim 1, 2, 3 or 4, wherein the synthesized waveform data is changed according to the strength or speed of a sound emitting operation to be used for emitting the musical sound.

9. The device for generating a waveform of a combined musical tone forth in claim 1, 2, 3, or 4, wherein the synthesized waveform data is changed according to the volume of the musical tone to be used for emitting the musical sound.

10. The device for generating a waveform of a combined musical tone as set of claim 1, 2, 3 or 4, wherein the synthesized waveform data is changed according to the tempo to be used for emitting the musical sound.

11. The device for generating a waveform of a combined musical tone as set of claim 1, 2, 3 or 4, wherein the synthesized waveform data is changed to the rhythm to be used for emitting the musical sound.

12. The device for generating a waveform of a combined musical tone as set of claim 1, 2, 3 or 4, wherein the synthesized waveform data is changed according to the kinds of special effects to be used for emitting the musical sound.

13. A system for storing and reading musical information, comprising:

single musical data and musical program storing means having a musical data area and a musical program area, musical data representing musical sounds being stored in said musical data area and a musical processing program for processing said musical data to generate and radiate musical sounds being stored in said musical program area;

musical data reading means for reading said musical data directly from said musical data area of said single musical data and musical program storing means, said musical data reading means included in a tone generating means;

musical program reading means for reading said musical processing program from said musical program area of said single musical data and musical program storing means;

switching means for switching a reading operation from the reading of said musical data by said musical data reading means to the reading of said musical processing program by said musical program reading means and for switching a reading operation from the reading of said musical processing program by said musical program reading means to the reading of said musical data by said musical data reading means; and switching controlling means for controlling in a time sharing manner the switching by said switching means.

14. The system for storing and reading musical information of claim 13, wherein said musical data reading means reads waveform data corresponding to a plurality of tones at one time by effecting the reading operation.

15. The system for storing and reading musical information of claim 15, wherein said musical program reading means reads said musical processing program corresponding to a plurality of steps at one time by effecting the reading operation.

16. The system for storing and reading musical information of claim 13, further comprising:

demultiplexing means for demultiplexing said musical data read by said musical data reading means and said musical processing program read by said musical program reading means, for selecting either said musical data or said musical processing program in accordance with a received control signal, and for outputting the selected musical data or musical processing program; and selection control means for outputting said control signal, which represents a least significant bit of address data, which is sent from a central processing unit to said musical data reading means and said musical data and said musical processing program.

17. The system for storing and reading musical information of claim 13, wherein said musical data representing musical sounds is composed of waveform data indicating levels of waveforms of musical sounds at each of originally sampled steps and difference data to be used for calculating waveform data at a step midway between the originally sampled successive steps.

18. The system for storing and reading musical information of claim 17, wherein said musical data reading means reads the waveform data at each of the originally sampled steps and the difference data to be used for calculating waveform data at a step midway between the originally sampled successive steps at a time by effecting a reading operation.

19. The device for generating a waveform of a combined musical tone of claim 1, 2, 3 or 4, wherein the waveform data of said at least two musical tones read out by said waveform data reading means utilizing a time share process, is read out according to a same accumulated frequency number data.

20. The system for storing and reading musical information of claim 13, wherein said musical data area stores waveform data of a plurality of musical tones, said musical data reading means reading out the waveform data of a plurality of musical tones stored in said musical data area utilizing a time share process, according to instructions generated by sound emission instructing means for emitting musical tones and selecting musical tones of said plurality of musical tones of the waveform data stored in said musical data area.

21. The system for storing and reading musical information of claim 13, wherein said musical data reading means includes means for generating musical tones and said musical program reading means includes a central processing unit.

22. A system for storing and reading musical information, comprising:

central processing means for processing musical data according to a musical processing program;

musical tone generating means for generating musical tones related to the musical processing by said central processing means;

single storage means having a central processing storage area and a musical tone storage area, said central processing means reading data from said central processing storage area and said musical tone generating means reading data directly from said musical tone storage area;

switching means for switching a reading operation from reading of said central processing storage area by said central processing means to reading of said musical tone storage area by said musical tone generating means and for switching a reading operation from reading of said musical tone storage area by said musical tone generating means to reading of said central processing storage area by said central processing means; and switch control means for controlling in a time sharing manner the switching of said switching means.

23. The system for storing and reading musical information of claim 22, wherein waveform data of a plurality of musical tones are stored in said musical tone storage area, the waveform data of a plurality of musical tones being read out utilizing a time sharing process, according to instructions generated by sound emission instruction means for emitting musical tones and selecting musical tones of said plurality of musical tones of the waveform data.

24. The system for storing and reading musical information of claim 22, wherein a musical processing program for processing music by said central processing means is stored in said central processing storage area.

25. The system for storing and reading musical information of claim 22, wherein the musical data for processing music by said central processing unit is stored in said central processing storage area.

26. The system of claim 13, wherein said musical data and said musical processing program are accessed at respective different times by said musical data reading means and said musical program reading means.

27. The system of claim 22, wherein storage addresses of said central processing storage area and said musical tone storage area are accessed at respective different times.

* * * * *